United States Patent [19]

Yoshida et al.

[11] Patent Number: 4,595,122

[45] Date of Patent: Jun. 17, 1986

[54] FUEL SUPPLYING SYSTEM FOR A FUEL SUPPLYING APPARATUS HAVING A PRESET FUEL SUPPLYING CAPABILITY

[75] Inventors: Takeomi Yoshida, Fujisawa; Kazuhisa Yamashita, Kawasaki, both of Japan

[73] Assignee: Tokico Ltd., Kanagawa, Japan

[21] Appl. No.: 673,191

[22] Filed: Nov. 19, 1984

[30] Foreign Application Priority Data

Nov. 22, 1983 [JP] Japan ..... 58-220126

[51] Int. Cl.[4] ..... B67D 5/30

[52] U.S. Cl. ..... 222/14; 222/26; 222/74; 364/479; 377/21

[58] Field of Search ..... 364/465, 479; 377/21; 222/14–16, 20–22, 25–28, 32, 35–37, 71, 74–75, 380

[56] References Cited

U.S. PATENT DOCUMENTS

| | | | |
|---|---|---|---|
| 3,603,480 | 9/1971 | Irie et al. | 222/20 |
| 3,797,703 | 3/1974 | Yamawaki et al. | 222/26 |
| 4,200,203 | 4/1980 | Rider | 222/14 |
| 4,254,328 | 3/1981 | Murray et al. | 222/14 X |
| 4,360,127 | 11/1982 | Maruyama et al. | 222/14 |
| 4,410,949 | 10/1983 | Huellinghorst et al. | 364/465 |
| 4,442,953 | 4/1984 | Miyamoto et al. | 222/14 |
| 4,534,046 | 8/1985 | Mihara | 377/21 |

*Primary Examiner*—Joseph J. Rolla
*Assistant Examiner*—Michael S. Huppert
*Attorney, Agent, or Firm*—Roberts, Spiecens & Cohen

[57] ABSTRACT

A fuel supplying system comprises a first circuit for discriminating whether a previous fuel supplying operation is carried out in a normal fuel supplying mode or a preset fuel supplying mode, and for storing a discriminated fuel supplying mode of the previous fuel supplying operation, a second circuit for discriminating whether a present fuel supplying operation is carried out in the normal fuel supplying mode or the preset fuel supplying mode, and for storing a discriminated fuel supplying mode of the present fuel supplying operation, a third circuit for counting a flow quantity signal generated from a flowmeter when a fuel flows through the flowmeter so as to fill a fuel supplying hose before a valve of the fuel supplying nozzle is opened upon starting of the present fuel supplying operation, and for storing a counted value as a correcting quantity, and a fourth circuit for reading out the correcting quantity stored in the third circuit depending on the previous fuel supplying mode and the present fuel supplying mode which are stored in the respective first and second circuits, and for correcting a fuel supplying quantity of the present fuel supplying operation according to the previous fuel supplying mode.

6 Claims, 87 Drawing Figures

PRIOR ART

IND
33
IND DRIV CKT
86
86A
88
COUNT CKT
85
85D
85F
85G
85E
85C
85B
85A
Data
Cout
Cin
Load
Reset
Down
Borrow
Up
COUNT CKT
84
84A
84B
84C
Cin
Cout
Reset
S Q FF R
MM T Q
DELAY
DET
C Q DFF D
FLOW QUANT GENE
19
SW
25B
25C
29

FROM ②
120

121
FLG1=0 and FLG3=1?
YES
123
FLG2=0 and FLG3=1?
NO
124
RET TO ②
COUNT SUPPLY QUANT WITHOUT COUNTING COUNT OF MEM 1
122
YES
COUNT SUPPLY QUANT WITHOUT COUNTING COUNT OF MEM 2
125
RET TO ②
126

FROM ②
130

131
FLG3=0 and FLG1=1?
NO
YES
133
FLG3=0 and FLG2=1?
NO
134
RET TO ②
COUNT SUPPLY QUANT WITH ADDING COUNT OF MEM 1
132
YES
COUNT SUPPLY QUANT WITH ADDING COUNT OF MEM 2
135
RET TO ②
136

FUEL SUPPLYING SYSTEM FOR A FUEL SUPPLYING APPARATUS HAVING A PRESET FUEL SUPPLYING CAPABILITY

BACKGROUND OF THE INVENTION

The present invention generally relates to fuel supplying systems for fuel supplying apparatuses having a preset fuel supplying capability, and more particularly to a fuel supplying system which corrects an error in a fuel supplying quantity which inevitably occurs when carrying out two successive fuel supplying operations in different fuel supplying modes such as a preset fuel supplying mode and a normal fuel supplying mode, so that an accurate fuel supplying operation can be carried out regardless of the fuel supplying mode.

Conventionally, there is a fuel supplying apparatus capable of carrying out a preset fuel supplying operation. According to this fuel supplying apparatus, a desired fuel supplying quantity or price is preset, and a predetermined fuel supplying operation is carried out to supply fuel corresponding to the preset fuel supplying quantity or price. Generally, such a fuel supplying apparatus comprises a pump, a flowmeter, a fuel supplying nozzle, a flow quantity generator, an indicator, a preset switch, and a fuel supply stopping means. The pump is provided at an intermediate part of a pipe arrangement which has one end thereof communicating to a tank. The fuel supplying nozzle is connected to the other end of the pipe arrangement through a fuel supplying hose. The flow quantity generator generates a flow quantity signal in correspondence with the quantity of fuel measured in the flowmeter. The indicator indicates the quantity of supplied fuel based on the flow quantity signal generated from the flow quantity generator. The preset switch is used to preset the desired fuel supplying quantity during a preset fuel supplying mode. The fuel supply stopping means stops the supply of fuel from the fuel supplying nozzle when the quantity of supplied fuel reaches the preset fuel supplying quantity which has been preset by the preset switch. The fuel supply stopping means is constituted by a motor which is provided for driving the pump, or by a stop valve or the like which is provided in the pipe arrangement.

During a normal fuel supplying operation, the starting and stopping of the fuel supply is performed by opening and closing a valve of the fuel supplying nozzle. On the other hand, during the preset fuel supplying operation, the start of the fuel supply is performd by opening the valve of the fuel supplying nozzle, but the stopping of the fuel supply is performed by the fuel supply stopping means. In other words, the fuel supply is stopped during the present fuel supplying operation by stopping the motor which drives the pump or by closing the stop valve provided in the pipe arrangement, for example. Further, the valve of the fuel supplying nozzle is operated after the preset fuel supplying operation is completed. For this reason, the valve of the fuel supplying nozzle remains open even when the fuel supply stopping means stops during the preset fuel supplying operation, and a part of the fuel within the pipe arrangement between the fuel supply stopping means and the fuel supplying nozzle and within the hose will flow into a fuel tank of a vehicle. The quantity of fuel which flows into the fuel tank of the vehicle in this manner after the actual preset fuel supplying operation is completed, depends on the length of the pipe arrangement and the hose, and differs for each fuel supplying station. Normally, this quantity of fuel is in the range of 0.1 liters to 0.5 liters. For example, in a case where the mode with which the fuel supplying operation is to be carried out differs between two successive fuel supplying operations, such as a case where a previous fuel supplying operation is carried out in the preset fuel supplying mode and the fuel supplying operation is now to be carried out in the normal fuel supplying mode, a small error is introduced in the actual quantity of fuel which is supplied.

In other words in a case where the fuel supplying operation is carried out in the normal fuel supplying mode for two successive fuel supplying operations, the quantity of fuel supplied during one fuel supplying operation is equal to the quantity of fuel supplied from a time when the valve of the fuel supplying nozzle is opened up to a time when the valve of the fuel supplying nozzle is closed, and the actual quantities of supplied fuel indicated on the indicator are the same for the two successive fuel supplying operations. On the other hand, when the previous fuel supplying operation is carried out in the preset fuel supplying mode and the fuel supplying operation is now to be carried out in the normal fuel supplying mode, the quantity of fuel which is required to fill a part of the pipe arrangement and the hose which become empty at the time when the previous preset fuel supplying operation is completed, by driving the pump when starting the fuel supplying operation in the normal fuel supplying mode, will be measured in the flowmeter before the valve of the fuel supplying nozzle is opened. Accordingly, the actual quantity of fuel which is supplied from the time when the valve of the fuel supplying nozzle is opened up to the time when the valve of the fuel supplying nozzle is closed, is less than the quantity indicated on the indicator by the quantity of fuel which is required to fill the empty part of the pipe arrangement and the hose at the start of the fuel supplying operation in the normal fuel supplying mode.

In a case where the fuel supplying operation is carried out in the preset fuel supplying mode for two successive fuel supplying operations, the quantity of fuel required to fill the empty part of the pipe arrangement and the hose at the start of the latter of the two successive fuel supplying operations is the same as the quantity of fuel which flows out of the fuel supplying nozzle at the completion of this latter fuel supplying operation. In other words, the quantity of fuel which is actually supplied, coincides with the quantity of supplied fuel which is indicated on the indicator. On the other hand, when the previous fuel supplying operation is carried out in the normal fuel supplying mode and the fuel supplying operation is now to be carried out in the preset fuel supplying mode, the actual quantity of fuel which is supplied from the time when the valve of the fuel supplying nozzle is opened up to the time when the valve of the fuel supplying nozzle is closed, is more than the quantity indicated on the indicator by the quantity of fuel which flows out of a part of the pipe arrangement and the hose at the completion of the fuel supplying operation in the preset fuel supplying mode.

SUMMARY OF THE INVENTION

Accordingly, it is a general object of the present invention to provide a novel and useful fuel supplying system for a fuel supplying apparatus having a preset fuel supplying capability, in which the disadvantages described heretofore are eliminated.

Another and more specific object of the present invention is to provide a fuel supplying system which stores as a correcting quantity an error in a fuel supplying quantity which inevitably occurs when carrying out two successive fuel supplying operations in different fuel supplying modes such as a preset fuel supplying mode and a normal fuel supplying mode, and corrects the error at the start of the fuel supplying operation by performing a predetermined addition or subtraction with the stored correcting quantity depending on the fuel supplying mode of the previous fuel supplying operation, so that a quantity of fuel which is supplied coincides with a quantity of fuel which is indicated on an indicator.

Still another object of the present invention is to provide a fuel supplying system comprising fuel supplying mode storing means for discriminating whether the previous fuel supplying mode is the normal fuel supplying mode or the preset fuel supplying mode which is responsive to a manipulation of a preset switch, correcting quantity storing means for counting pulses of a flow quantity signal which is generated from a flow quantity generator and for storing the counted value as a correcting quantity when the fuel flows through a flowmeter so as to fill a part of a pipe arrangement and a fuel supplying hose at a start of a fuel supplying operation before a valve of a fuel supplying nozzle is opened, and correcting means for reading out a correcting quantity from the correcting quantity storing means depending on the fuel supplying mode of the previous fuel supplying operation and for correcting the fuel supplying quantity. The fuel supplying system according to the present invention corrects the fuel supplying quantity when carrying out a fuel supplying operation, depending on the fuel supplying mode of the previous fuel supplying operation.

Other objects and further features of the present invention will be apparent from the following detailed description when read in conjunction with the accompanying drawings.

DETAILED DESCRIPTION

Figure 1:
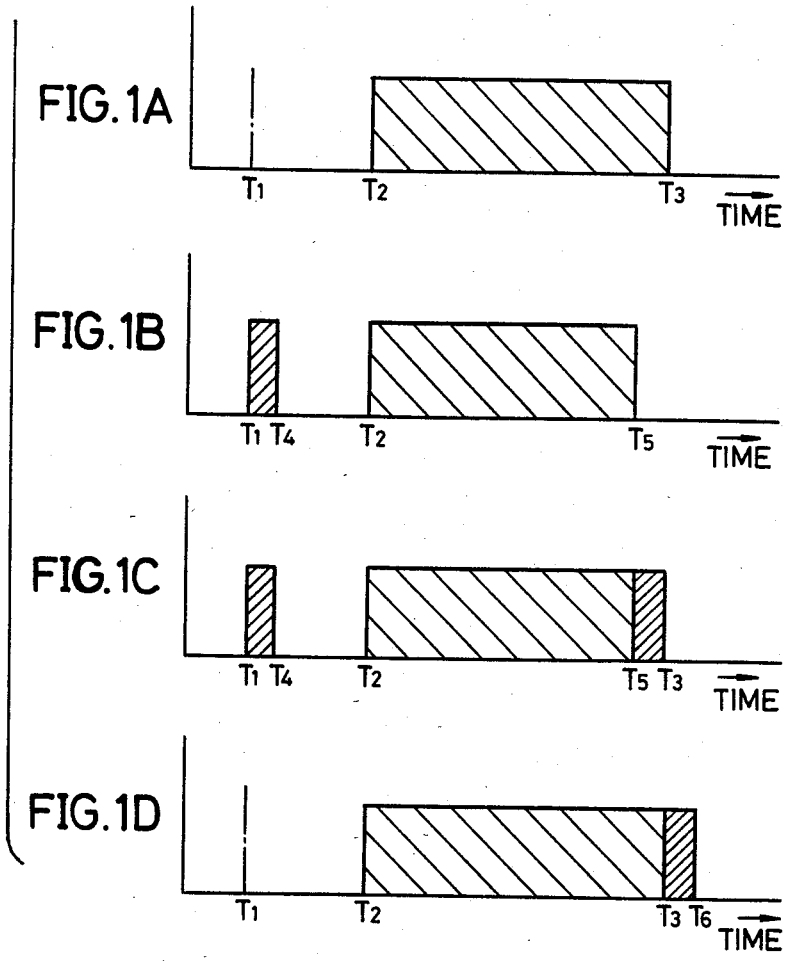
FIGS. 1A, 1B, 1C, and 1D respectively show relationships between an actual quantity of supplied fuel and a quantity of fuel indicated on an indicator in a conventional fuel supplying system, for different combinations of fuel supplying modes of two successive fuel supplying operations.

As described before, a fuel supplying operation in a normal fuel supplying mode is completed by closing a valve of a fuel supplying nozzle. Accordingly, in a case where a first of two successive fuel supplying operations is carried out in the normal fuel supplying mode, a fuel remains within a fuel supplying hose. For this reason, in a case where a latter of the two successive fuel supplying operations is also carried out in the normal fuel supplying mode, the fuel will not flow through a flowmeter even when a pump is driven at a time $T_1$ as shown in FIG. 1A, and a supply of fuel is started immediately at a time $T_2$ when the valve of the fuel supplying nozzle is opened. As a result, an actual quantity of fuel which is supplied from the fuel supplying nozzle between times $T_2$ and $T_3$, is equal to a quantity of fuel which flows through the flowmeter and is indicated on an indicator, and no error is introduced between the two quantities.

However, a fuel supplying operation in a preset fuel supplying mode is completed by stopping the drive of the pump in a state where the valve of the fuel supplying nozzle is open. Hence, in a case where the first of two successive fuel supplying operations is carried out in the present fuel supplying mode, the fuel supplying hose is empty because the fuel within the fuel supplying hose flows out through the fuel supplying nozzle when the first fuel supplying operation is completed. The valve of the fuel supplying nozzle is closed after the first fuel supplying operation is completed. Consequently, in a case where the latter of the two successive fuel supplying operations is carried out in the normal fuel supplying mode and the pump is driven at the time $T_1$, the fuel flows through the flowmeter until a time $T_4$ when the fuel supplying hose becomes filled by the fuel as shown in FIG. 1B. In other words, the quantity of fuel which flows between the times $T_1$ and $T_4$ is measured in the flowmeter. As a result, when the valve of the fuel supplying nozzle is opened at the time $T_2$ so as to start the latter fuel supplying operation in the normal fuel supplying mode, a quantity of fuel which is the same as the quantity of fuel supplied in the case described in conjunction with FIG. 1A will be reached at a time $T_5$ which is prior to the time $T_3$, since the fuel within the fuel supplying hose is supplied between the times $T_1$ and $T_4$. Therefore, even when the quantity of supplied fuel indicated on the indicator is equal to the quantity of supplied fuel shown in FIG. 1A, the actual quantity of supplied fuel is equal to the quantity of fuel which is supplied between the times $T_2$ and $T_5$ and is less than the quantity of supplied fuel shown in FIG. 1A.

In a case where the two successive fuel supplying operations are carried out in the preset fuel supplying mode and the latter of the two successive fuel supplying operations is started by driving the pump at the time $T_1$, the fuel flows through the flowmeter up to the time $T_4$ as shown in FIG. 1C. However, when the pump is stopped at the time $T_5$ so as to stop the fuel supplying operation in the preset fuel supplying mode, the fuel within the fuel supplying hose flows out of the fuel supplying nozzle up to a time $T_3$. As a result, the actual quantity of supplied fuel is equal to the quantity of supplied fuel indicated on the indicator.

Further, in a case where the first of two successive fuel supplying operations is carried out in the normal fuel supplying mode and the latter of the two successive fuel supplying operations is carried out in the preset fuel supplying mode and the pump is driven at the time $T_1$, the fuel does not flow through the flowmeter. However, when the pump is stopped at the time $T_3$, the fuel within the fuel supplying hose flows out of the fuel supplying nozzle up to a time $T_6$ as shown in FIG. 1D. As a result, the quantity of supplied fuel indicated on the indicator is the quantity of fuel supplied between the times $T_2$ and $T_3$, however, the actual quantity of supplied fuel is the quantity of fuel supplied between the times $T_2$ and $T_6$. In other words, the actual quantity of supplied fuel in this case is greater than the quantity of supplied fuel indicated on the indicator.

The present invention eliminates the problem of the conventional fuel supplying system, that is, prevents differences from occurring between the actual quantity of supplied fuel and the quantity of supplied fuel indicated on the indicator, regardless of the combination of the fuel supplying modes of the two successive fuel supplying operations.

Figure 2:
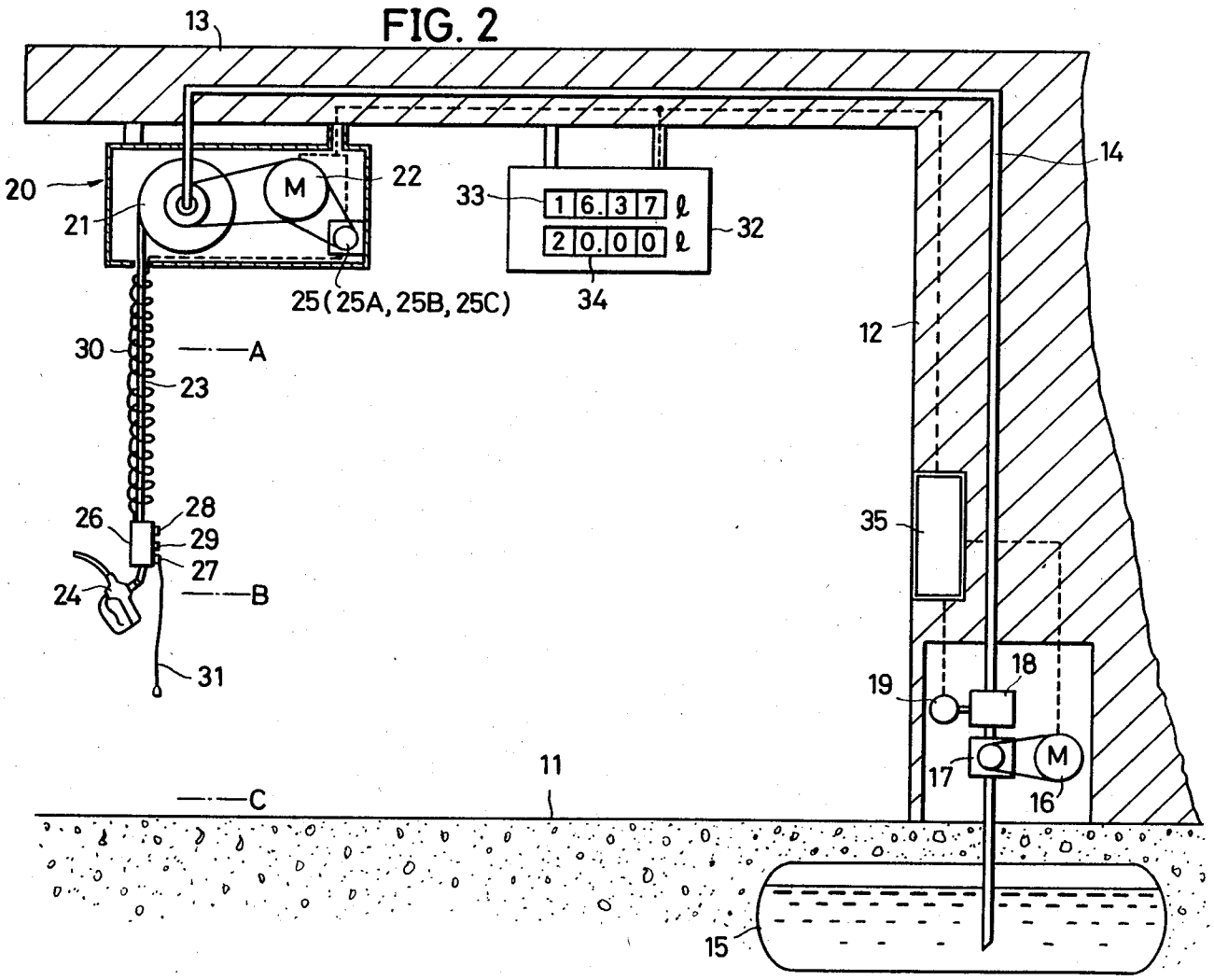
FIG. 2 shows an example of a fuel supplying apparatus which may be applied with a fuel supplying system according to the present invention.

An example of a fuel supplying apparatus which may be applied with the fuel supplying system according to the present invention, is shown in FIG. 2.

In FIG. 2, a structure 12 including an office or the like, is built on a building site 11. A ceiling part 13 made up of a ceiling, a crossbeam, and a canopy, is formed on the upper part of the structure 12. A pipe arrangement 14 is provided along the structure 12, and one end of the pipe arrangement 14 communicates to an underground tank 15 which is provided under the site 11. The other end of the pipe arrangement 14 connects to a hose elevator mechanism 20 which will be described later on in the specification. A pump 17 which is driven by a motor 16, and a flowmeter 18 for measuring the quantity of supplied fuel, are provided in the pipe arrangement 14. A flow quantity generator 19 which generates a flow quantity signal proportional to a quantity measured in the flowmeter 18, is provided on the flowmeter 18.

The hose elevator mechanism 20 is provided on the ceiling part 13. The hose elevator mechanism 20 comprises a rotatable hose reel 21 and a motor 22 for rotating the hose reel 21 is forward and reverse directions. The other end of the pipe arrangement 14 is connected to the hose reel 21, and a fuel supplying hose 23 having a fuel supplying nozzle 24 on the tip end thereof is wound on the hose reel 21. On the other hand, a switch box 25 for detecting the position of the fuel supplying nozzle 24, is provided within the hose elevator mechanism 20. Switches 25A, 25B, and 25C are built within the switch box 25, and detect the position of the fuel supplying nozzle 24 responsive to the rotation of the motor 22 or the hose reel 21. The switch 25A detects that the fuel supplying nozzle 24 is in an uppermost accommodated position A, the switch 25B detects that the fuel supplying nozzle 24 is in a waiting position B which is approximately 1.8 meters from the ground, and the switch 25C detects that the fuel supplying nozzle 24 is in a fuel supplying position C for carrying out a fuel supplying operation with respect to a vehicle.

A switch box 26 is provided on the fuel supplying nozzle 24 or on the hose 23 in a vicinity of the fuel supplying nozzle 24. A lowering switch 27 for lowering the fuel supplying nozzle 24 to the fuel supplying position C from the waiting position B, a raising switch 28 for raising the fuel supplying nozzle 24 to the waiting position B from the fuel supplying position C, and a single preset switch 29 for presetting a preset fuel supplying quantity as will be described later on, are provided on the switch box 26. The switches 27, 28, and 29 are coupled to a control circuit which will be described later, through a signal line 30 which is spirally wound around the hose 23. A pull-string 31 is connected to the lowering switch 27. In the embodiment which will be described hereinafter, a preset fuel supplying quantity is preset by pushing the single preset switch 29, and the preset fuel supplying quantity is preset to 10 liters, 20 liters, 30 liters, . . . responsive to the number of times the preset switch 29 is pushed. However, other means may be used to preset the preset fuel supplying quantity. For example, a ten-key preset switch may be used and the preset fuel supplying quantity may be preset by pushing one of ten keys. Further, a dial type preset switch or a card type preset switch may be used. The card type preset switch reads a card which is inserted into a card reader box and presets the fuel supplying quantity depending on the inserted card. On the other hand, the preset switch 29 need not be provided on the switch box 26, and may be provided at appropriate positions such as within the office or on the card reader box.

An indicator case 32 is provided on the ceiling part 13 of the structure 12, for example, where the indicator case 32 is easily visible by a customer. An indicator 33 for indicating a quantity of fuel measured in the flowmeter 18, and a preset quantity indicator 34 for indicating a preset fuel supplying quantity which is preset by the preset switch 29, are provided within the indicator case 32.

Figure 3:
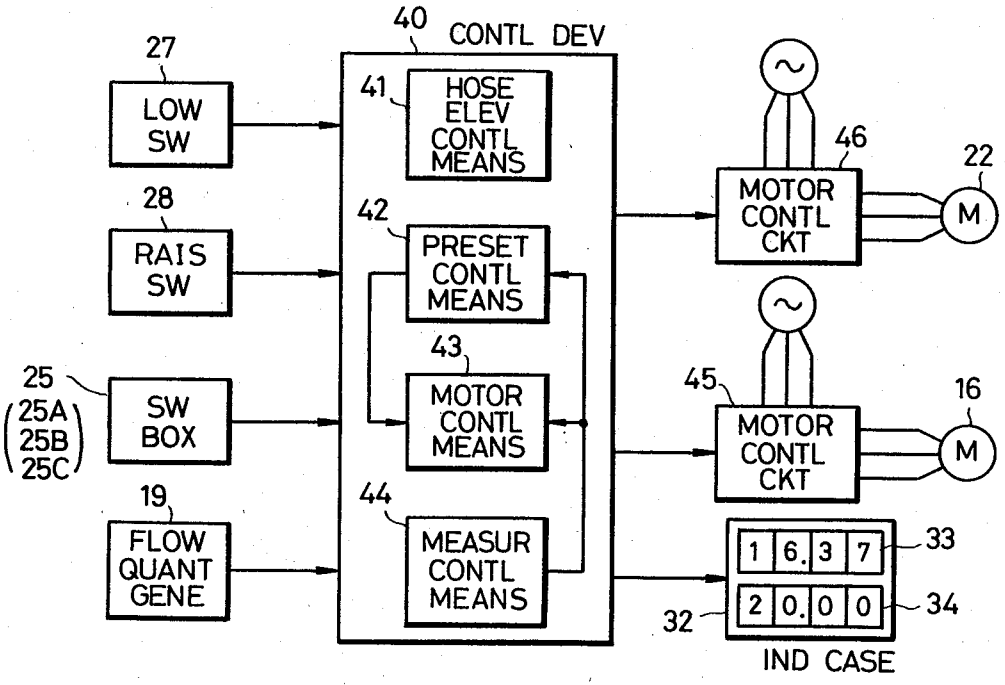
FIG. 3 is a general systematic block diagram showing an embodiment of a control device in the fuel supplying system according to the present invention.

A control panel 35 is provided within the office of the structure 12, for example. A control device 40 shown in FIG. 3 is provided within the control panel 35. The control device 40 generally comprises hose elevator control means 41 for controlling the motor 22, preset control means 42 for comparing a preset fuel supplying quantity which is preset by the preset switch 29 and an actual quantity of supplied fuel and for stopping the motor 16 when the two compared quantities coincide, motor control means 43 for starting and stopping the motor 16 responsive to the manipulation of the switches 25A, 25B, and 25C within the switch box 25, and measurement control means 44 for causing the indicator 33 to indicate the quantity of supplied fuel. The measurement control means 44 comprises a circuit shown in FIG. 4, and carries out a correction depending on the fuel supplying mode. The input side of the control device 40 is coupled to the flowmeter 18, the switches 25A, 25B, and 25C within the switch box 25, the lowering switch 27, the raising switch 28, and a main elevator switch (not shown). On the other hand, the output side of the control device 40 is coupled to a motor control circuit 45 for controlling the motor 16, a motor control circuit 46 for controlling the motor 22, and the indicators 33 and 44.

First, description will be given with respect to the general operation of the fuel supplying apparatus.

It will be assumed that the main elevator switch is manipulated, the nozzle 24 is lowered to the waiting position B shown in FIG. 2 from the accommodated position A, and the switch 25B is closed. In this state, the pull-string 31 is pulled so as to close the lowering switch 27 and lower the nozzle 24 to the fuel supplying position C. When the lowering switch 27 is closed, a lowering signal is supplied to the motor control circuit 46 from the hose elevator control means 41, and the motor 22 rotates so as to lower the nozzle 24. The switch 25C closes when the nozzle 24 reaches the fuel supplying position C, and the motor 22 stops rotating. During this time, when the switch 25B is opened from the closed state as the motor 22 rotates so as to lower the nozzle 24, a driving signal is supplied to the motor control circuit 45 from the motor control means 43 so as to start the motor 16. When the nozzle 24 is lowered to the fuel supplying position C, a value indicated on the indicator 33 with respect to the previous fuel supplying operation is reset.

When the fuel supplying operation is to be carried out in the normal fuel supplying mode, the nozzle 24 is inserted into a fuel tank of the vehicle and a valve of the nozzle 24 is opened. The fuel in the underground tank 15 is supplied to the fuel tank of the vehicle through the pipe arrangement 14, the pump 17, the flowmeter 18, and the hose 23. While the fuel is being supplied to the fuel tank of the vehicle, a flow quantity signal generated from the flow quantity generator 19 is counted in the measurement control means 44 and the quantity of supplied fuel is indicated on the indicator 33.

On the other hand, when the fuel supplying operation is to be carried out in the preset fuel supplying mode, a desired preset fuel supplying quantity of 20 liters, for example, is preset by manipulating the preset switch 29. The preset fuel supplying quantity is stored in the preset control means 42, and is indicated on the indicator 34. The fuel supplying operation is started in this state when the nozzle 24 is inserted into the fuel tank of the vehicle and the valve of the nozzle 24 is opened as in the case of the fuel supplying operation in the normal fuel supplying mode. When the actual quantity of supplied fuel reaches the preset fuel supplying quantity, a predetermined quantity signal is supplied to the motor control circuit 45 from the preset control means 42 so as to stop the motor 16. Thereafter, the nozzle 24 is removed from the fuel tank of the vehicle and the valve of the nozzle 24 is closed.

The raising switch 28 is closed in order to raise the nozzle 24 up to the waiting position B from the fuel supplying position C. As a result, a raising signal is supplied to the motor control circuit 46 from the elevator control means 41, and the motor 22 is rotated so as to raise the nozzle 24. The switch 25B closes when the nozzle 24 reaches the waiting position B, and the motor 22 is stopped. In the case of the fuel supplying operation in the normal fuel supplying mode, a stop signal is supplied to the motor control circuit 45 when the switch 25C opens, so as to stop the motor 16.

The basic operation of the fuel supplying system described heretofore, is essentially the same as the operation of the conventional fuel supplying system.

Figure 4:
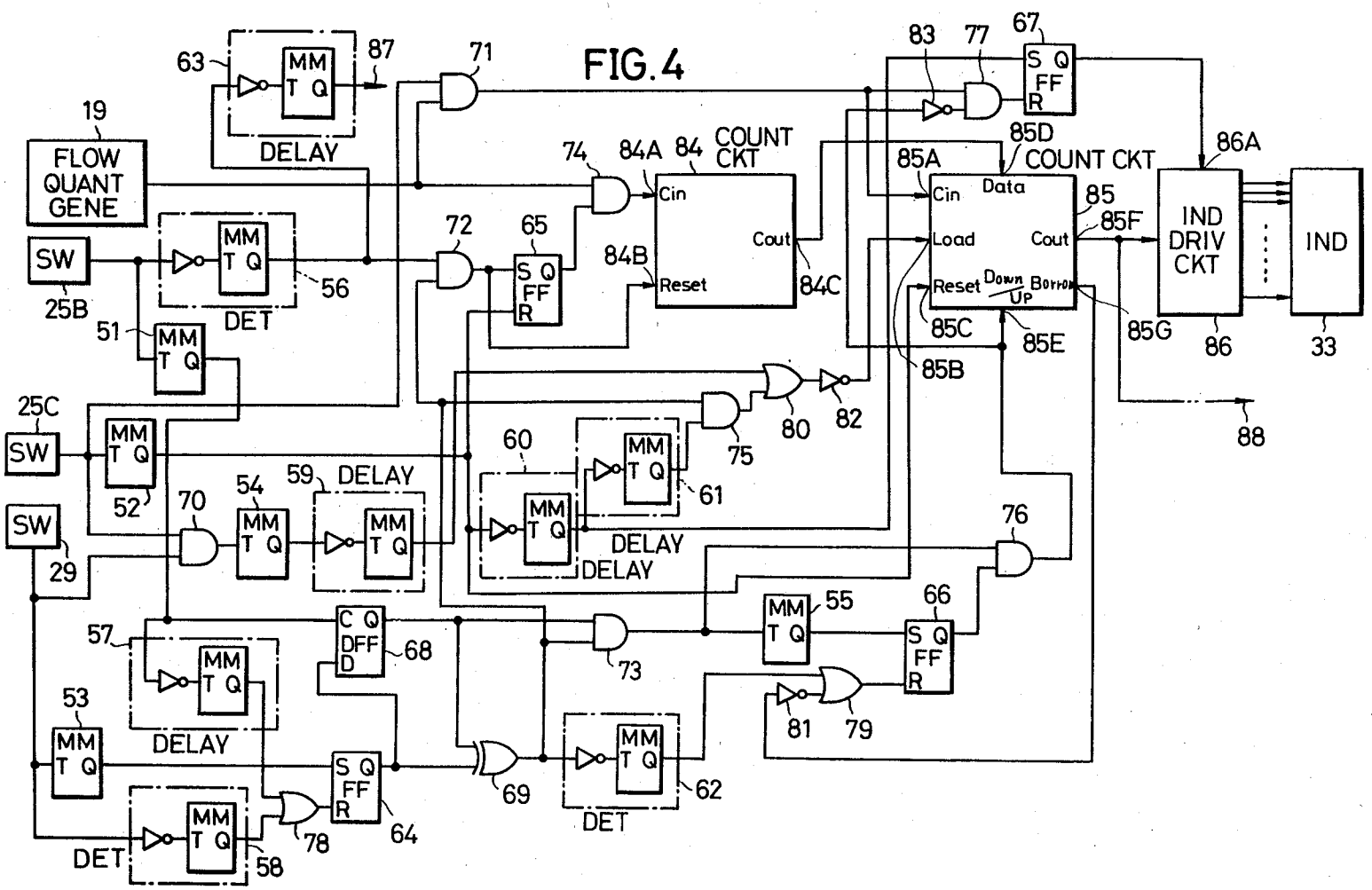
FIG. 4 is a systematic circuit diagram showing an embodiment of a concrete circuit of measurement control means in the block system shown in FIG.3.

FIG. 4 is a systematic circuit diagram showing the measurement control means 44 shown in FIG. 3. In FIG. 4, a monostable multivibrator (represented by MM) 51 is provided for the detection of the waiting position B, and is operated responsive to the closing of the switch 25B. A monostable multivibrator 52 is provided for the detection of the fuel supplying position C, and is operated responsive to the closing of the switch 25C. In addition, a monostable multivibrator 53 is provided for the detection of the preset fuel supplying operation, and is operated responsive to the manipulation of the preset switch 29. The monostable multivibrators 51 through 53 and monostable multivibrators 44 and 45 which will be described later, operate as one-shot multivibrators.

Circuits 56, 57, 58, 59, 60, 61, 62, and 63 are each designed to operate by detecting a rise in an input signal, and each comprises an inverter and a monostable multivibrator. The detecting circuit 56 operates responsive to the opening of the switch 25B. The detecting circuit 58 detects the normal fuel supplying operation by detecting that the preset fuel supplying operation responsive to the preset switch 29 has been cancelled. The detecting circuit 62 detects a cancellation of a correction by detecting a cancellation of a correction instruction signal which will be described later. The delay circuits 57, 59, 60, 61, and 63 carry out delays so as to match the timings.

Flip-flop circuits 64, 65, 66, and 67 are each made up of an R-S type flip-flop, for example. The flip-flop circuit 64 is used to store the fuel supplying mode with which the fuel supplying operation is being carried out. A Q-output of the flip-flop circuit 64 assumes a level "1" when a preset fuel supplying operation is being carried out, and the Q-output of the flip-flop circuit 64 assumes a level "0" when a normal fuel supplying operation is being carried out. The flip-flop circuit 67 is used to hold the reset state of a driver which will be described later.

A flip-flop circuit 68 is made up of a D-type flip-flop, and is used to store the fuel supplying mode with which a previous fuel supplying operation was carried out. The output of the flip-flop circuit 64 is entered into the flip-flop 68 through a data input terminal D, when a Q-output of the flip-flop 51 is applied to a clock input terminal C of the flip-flop 68. The previous fuel supplying operation is carried out in the normal fuel supplying mode when a Q-output of the flip-flop 68 assumes a level "1", and the previous fuel supplying operation is carried out in the preset fuel supplying mode when the Q-output of the flip-flop assumes a level "0".

Output terminals Q of the flip-flops 64 and 68 are respectively connected to input terminals of an exclusive-OR circuit 69. The exclusive-OR circuit 69 produces an output having a level "1" as a correction-necessary signal when the previous and present fuel supplying operations are not of the same fuel supplying mode. On the other hand, the exclusive-OR circuit 69 produces an output having a level "0" as a correction-unnecessary signal when the previous and present fuel supplying operations are of the same fuel supplying mode.

An AND circuit 72 is provided for resetting a correcting quantity, and resets a correcting quantity counting circuit 84 which will be described later only when the previous fuel supplying operation is carried out in the preset fuel supplying mode. An AND circuit 73 is provided for instructing a subtraction, and instructs a subtracting correction to a supplied quantity counting circuit 85 which will be described later only when an output of the AND circuit 73 assumes a level "1". An AND circuit 74 is provided for gating a correction pulse. An AND circuit 76 operates to instruct addition and subtraction, and produces a subtraction signal when an output thereof assumes a level "1" and produces an addition signal when an output thereof assumes a level "0". An AND circuit 77 is provided for cancelling the latch of an indicator driving circuit 86 which will be described later.

As described before, the correcting quantity counting circuit 84 stores as a correcting quantity the quantity of fuel which is required to fill a part of the pipe arrangement 14 and the hose 23 when carrying out a preset fuel supplying operation subsequent to a preset fuel supplying operation. The correcting quantity counting circuit 84 has an input terminal 84A coupled to the output of the AND circuit 74, a reset terminal 84B coupled to the output of the AND circuit 72, and an output terminal 84C.

The supplied quantity counting circuit 85 counts the flow quantity signal from the flow quantity generator 19. Further, the supplied quantity counting circuit 85 has a function of making access to the correcting quantity which is stored in the correcting quantity counting circuit 84 depending on the fuel supplying mode with which the previous fuel supplying operation is carried out, and performs an adding or subtracting correction with respect to the supplied quantity. The supplied quantity counting circuit 85 has input terminals 85A through 85E, an output terminal 85F, and a borrow terminal 85G. The input terminal 85A is coupled to the output of an AND circuit 71, and the input terminal 85B is coupled to the output of an inverter 82. The reset terminal 85C is coupled to the Q-output terminal of the monostable multivibrator 52, and the input terminal 85D is coupled to the output terminal 84C of the correcting quantity counting circuit 84. The input terminal 85E is coupled to the output of the AND circuit 76. A borrow signal is supplied to an inverter 81 through the borrow terminal 85G. The supplied quantity counting circuit 85 successively subtracts the count of the correcting quantity data responsive to the flow quantity signal which is supplied thereto as a clock signal, and produces through the borrow terminal 85G a low level pulse having a width which is equal to a low level part of the flow quantity signal, responsive to a fall in the flow quantity signal, when the result of the subtraction becomes equal to "0", that is, when the count is decreased to "0" by counting down in a manner . . . , "4", "3", "2", "1", "0". Normally, a high level output is produced through the borrow terminal 85G.

The indicator driving circuit 86 is coupled to the output terminal 85F of the supplied quantity counting circuit 85, and drives indicator elements (for example, seven segments) in each digit of the indicator 33 responsive to a supplied quantity signal. A terminal 86A of the indicator driving circuit 86 is coupled to the Q-output terminal of the flip-flop circuit 67, and the reset state of the indicator 33 is maintained while the flip-flop circuit 67 produces a signal having a level "1". The indicator elements in each digit of the indicator 33 are driven internally even when the indicator 33 is in a reset state. A signal line 87 through which a pulse is transmitted, is coupled to the motor control means 43. A signal line 88 through which the supplied quantity signal is transmitted, is coupled to the preset control means 42.

Next, description will be given with respect to the operation of the measurement control means 44.

First, description will be given for a case where two successive fuel supplying operations are carried out in the normal fuel supplying mode, by referring to a time chart shown in FIG. 5. In this case, no error is introduced as described before in conjunction with FIG. 1A, and there is no need to perform a correcting process. FIGS. 5(A) through 5(S) respectively show in sequence, the output of the switch 25B, the output of the monostable multivibrator 51, the output of the detecting circuit 56, the output of the switch 25C, the output of the monostable multivibrator 52, the output of the preset switch 29, the output of the monostable multivibrator 53, the output of the flip-flop circuit 68, the output of the flip-flop circuit 64, the output of the exclusive-OR circuit 69, the output of the AND circuit 73, the output of the flow quantity generator 19, the output of the AND circuit 71, the output of the AND circuit 74, the output of the AND circuit 72, the output of the inverter 82, the output of the AND circuit 76, the output through the borrow terminal 85G, and the output of the flip-flop circuit 67. The time charts shown in FIGS. 6(A) through 6(S), FIGS. 7(A) through 7(S), and FIGS. 8(A) through 8(S) which will be described later, similarly show the outputs of the same circuits as FIGS. 5(A) through 5(S).

It will be assumed that the nozzle 24 is in the fuel supplying position C, the nozzle 24 is inserted into the fuel tank of the vehicle, and the normal fuel supplying operation is being carried out during the first of the two successive fuel supplying operations. In this state, the flip-flop circuit 68 which stores the previous fuel supplying mode produces a signal having a level "1" and a flip-flop circuit 64 which stores the fuel supplying mode of the preset fuel supplying operation produces a signal having a level "0", when the fuel supplying operation prior to the first of the two successive fuel supplying operations is carried out in the preset fuel supplying mode, for example. In addition, the exclusive-OR circuit 69 and the AND circuit 73 each produce a signal having a level "1".

Figure 5:
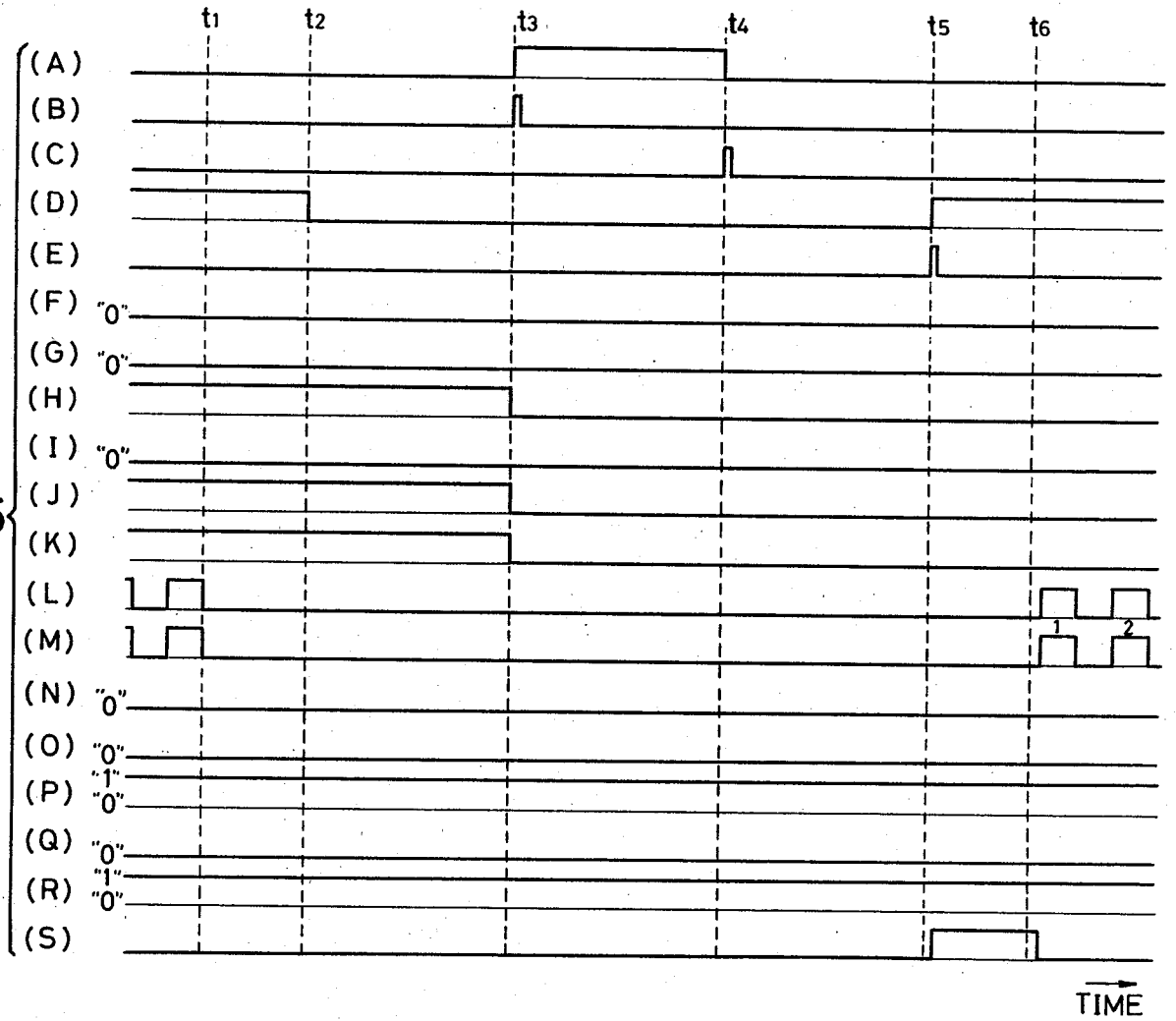
FIGS. 5(A) through 5(S) are time charts showing output signals at each part of the circuit system shown in FIG. 4 for a case where a first of two successive fuel supplying operations is carried out in a normal fuel supplying mode and a latter of the two successive fuel supplying operations is also carried out in the normal fuel supplying mode.

When the first of the two successive fuel supplying operation is completed, the operator closes the valve of the nozzle 24 at a time $t_1$ in FIG. 5, and the raising switch 28 is closed at a time $t_2$ so as to raise the nozzle 24. When the nozzle 24 reaches the waiting position B at a time $t_3$, a waiting position detection signal is produced from the switch 25B as shown in FIG. 5(A). The monostable multivibrator 51 detects the waiting position B responsive to a rise in the waiting position detection signal, and produces as a one-shot a waiting position arrival signal shown in FIG. 5(B). The output waiting position arrival signal of the monostable multivibrator 51 is supplied to the clock input terminal C of the flip-flop circuit 68, and an output signal of the flip-flop circuit 64 having a level "0" is entered into the flip-flop circuit 68. Accordingly, the flip-flop circuit 68 stores the output signal of the flip-flop circuit 64 indicating that the first of the two successive fuel supplying operations is carried out in the normal fuel supplying mode. On the other hand, the output waiting position arrival signal of the monostable multivibrator 51 is passed through the delay circuit 57 which operates responsive to a one-shot fall, and is supplied to the reset terminal R of the flip-flop circuit 64 through an OR circuit 78. The preset switch 29 is not manipulated because the latter of the two successive fuel supplying operations is also carried out in the normal fuel supplying mode. Thus, the flip-flop circuit 64 remains in the reset state, and an output signal which has a level "0" and indicates a normal fuel supplying mode is produced through the Q-output terminal of the flip-flop circuit 64. As a result, the flip-flop circuit 64 stores the signal indicating that the present (latter) supplying operation is carried out in the normal fuel supplying mode.

In addition, the signal level is "0" at the inputs of the exclusive-OR circuit 69, and the exclusive-OR circuit 69 produces a signal having a level "0" representing a correction-unnecessary signal. The signal level is "0" at the output of the AND circuit 73, and the AND circuit 73 stops producing the subtraction instruction signal. The detecting circuit 62 produces a correction cancellation detection signal as a one-shot, responsive to a fall in the output of the exclusive-OR circuit 69, and resets the flip-flop circuit 66 through an OR circuit 79. Because the signal level is "0" at the inputs of the AND circuit 76, the AND circuit 76 produces a signal having a level "0" as the addition signal. This output addition signal of the AND circuit 76 is supplied to the input terminal 85E of the supplied quantity counting circuit 85 so as to instruct an addition (count-up). The output addition signal of the AND circuit 76 is also supplied to the AND circuit 77 through an inverter 83, so as to open the gate of the AND circuit 77 and prepare the AND circuit 77 for cancelling the latch.

Next, when the lowering switch 27 is closed at a time $t_4$ so as to lower the nozzle 24 from the waiting position B, the detecting circuit 56 produces a separation signal shown in FIG. 5(C) as a one-shot responsive to a fall in the output of the switch 25B that occurs due to the opening of the switch 25B. The output separation signal of the detecting circuit 56, which indicates that the nozzle 24 has separated from the waiting position B, is supplied to the AND circuit 72. However, in this state, the exclusive-OR circuit 69 produces a signal having a level "0" as the correction-unnecessary signal, and the gate of the AND circuit 72 is accordingly closed. Hence, the reset state of the flip-flop circuit 65 is maintained even when the output separation signal of the detecting circuit 56 is supplied to the AND circuit 72. As a result, no signal is supplied to the AND circuit 74 from the flip-flop circuit 65. Consequently, no flow quantity signal is supplied to the correcting quantity counting circuit 84 from the flow quantity generator 19, and the correcting quantity counting circuit 84 will not be reset.

When the nozzle 24 starts to move downwardly and the separation signal is produced from the detecting circuit 56, a one-shot pump driving signal is produced from the delay circuit 63 responsive to a fall in the output separation signal of the detecting circuit 56. This pump driving signal is supplied to the motor control means 43 through a signal line 87. The motor control means 43 supplies a driving signal to the motor control circuit 45 so as to drive the motor 16. Because the first of the two successive fuel supplying operation is carried out in the normal fuel supplying mode, a part of the pipe arrangement 14 and the hose 23 are already filled with the fuel, and the flowmeter 18 will not operate. However, even if the flowmeter 18 were to operate in this state and the flow quantity signal is produced from the flow quantity generator 19, the correcting quantity counting circuit 84 will not operate since the gate of the AND circuit 74 is closed.

When the downwardly moving nozzle 24 reaches the fuel supplying position C at a time $t_5$, the switch 25C produces a signal shown in FIG. 5(D). As a result, the gate of the AND circuit 71 is opened, and the monostable multivibrator 52 produces as a one-shot a fuel supplying position arrival signal shown in FIG. 5(E) responsive to a rise in the output of the switch 25C. The output fuel supplying position arrival signal of the monostable multivibrator 52 is supplied to the reset terminal 85C of the supplied quantity counting circuit 85, and resets the counted value related to the previous (first) fuel supplying operation. The indicator driving circuit 86 and the value in the indicator 33 are also reset. The output fuel supplying position arrival signal of the monostable multivibrator 52 is delayed in the delay circuit 60, and is supplied to the input terminal S of the flip-flop circuit 67. The flip-flop circuit 67 produces through the Q-output terminal thereof a signal having a level "1" which represents a reset state latching signal, and supplies this reset state latching signal to an input terminal 86A of the indicator driving circuit 86. As a result, the indicator driving circuit 86 is latched in a state where all of the digits are reset. On the other hand, a one-shot output signal is produced from the delay circuit 61 responsive to a fall in the one-shot output signal of the delay circuit 60, however, the AND circuit 75 will not produce an output because the output signal of the exclusive-OR circuit 69 having a level "0" is supplied to the AND circuit 75. The fuel supplying position arrival signal is also supplied to the reset terminal R of the flip-flop circuit 65, and the flip-flop circuit 65 is maintained in the reset state.

Further, when the nozzle 24 is inserted into the fuel tank of the vehicle and the valve of the nozzle 24 is opened at a time $t_6$, the fuel is supplied from the nozzle 24, and the flowmeter 18 operates. A flow quantity signal shown in FIG. 5(L) is generated from the flow quantity generator 19. The flow quantity signal is passed through the AND circuit 71, and an output signal of the AND circuit 71 shown in FIG. 5(M) is supplied to the input terminal 85A of the supplied quantity counting circuit 85 so as to start the count. At the same time, a first pulse of the flow quantity signal is supplied to the AND circuit 77. The gate of the AND circuit 77 is open due to the output signal of the inverter 82 supplied thereto, and thus, the AND circuit 77 supplies a signal having a level "1" to the reset terminal R of the flip-flop circuit 67 as a latch cancelling signal. As a result, the flip-flop circuit 67 stops producing the reset state latching signal, and the indicator driving circuit 86 supplies a driving signal to the indicator 33 for each of the digits so as to start the successive indication of values "1", "2", "3", "4", . . . .

The latter of the two successive fuel supplying operations is started in the manner described heretofore, and the valve of the nozzle 24 is closed when the quantity of supplied fuel reaches a desired quantity.

Next, description will be given with respect to a case where the first of the two successive fuel supplying operations is carried out in the preset fuel supplying mode and the latter of the two successive fuel supplying operations is carried out in the normal fuel supplying mode, by referring to a time chart shown in FIG. 6. In this case, an error corresponding to a quantity required to fill a part of the pipe arrangement 14 and the hose 23 occurs as described before in conjunction with FIG. 1B, and it is necessary to perform a subtraction correcting process as will be described hereinafter.

It will be assumed that the nozzle 24 is in the fuel supplying position C and that the first of the two successive fuel supplying operations is being carried out in the preset fuel supplying mode. Further, it will be assumed that the fuel supplying operation carried out prior to the first of the two successive fuel supplying operations is carried out in the normal fuel supplying mode, for example. Thus, the flip-flop circuit 68 which stores the previous fuel supplying mode produces a signal having a level "0", and the flip-flop circuit 64 which stores the present fuel supplying mode produces a signal having a level "1".

When the predetermined quantity signal is produced from the preset control means 42 and the motor 16 stops at a time $t_7$ when the first of the two successive fuel supplying operations is completed, the operator removes the nozzle 24 from the fuel tank of the vehicle and closes the valve of the nozzle 24 at a time $t_8$. The nozzle 24 is raised by closing the raising switch 28 at the time $t_2$. In this case, the fuel within a part of the pipe arrangement 14 and the hose 23 flows out of the nozzle 24 even when the motor 16 stops, and a part of the pipe arrangement 14 and the hose 23 are empty. When the nozzle 24 reaches the waiting position B at the time $t_3$, the switch 25B produces a waiting position detection signal shown in FIG. 6(A). The monostable multivibrator 51 detects the waiting position B responsive to a rise in the waiting position detection signal, and produces a waiting position arrival signal shown in FIG. 6(B) as a one-shot. The output waiting position arrival signal of the monostable multivibrator 51 is supplied to the clock input terminal C of the flip-flop circuit 68, and the output signal of the flip-flop circuit 64 having a level "1" is entered into the flip-flop circuit 68. Accordingly, the signal indicating that the previous (first) fuel supplying operation is carried out in the preset fuel supplying mode, is stored in the flip-flop 68. On the other hand, the output waiting position arrival signal of the monostable multivibrator 51 is passed through the delay cirucit 57 which operates responsive to a one-shot fall in the waiting position arrival signal, and is supplied to the reset terminal R of the flip-flop circuit 64 through the OR circuit 78. Thus, the flip-flop circuit 64 is reset with the delay time of the delay circuit 57, and a signal which has a level "0" and indicates that the present (latter) fuel supplying operation is carried out in the normal fuel supplying mode is produced through the Q-output terminal of the flip-flop circuit 64 as shown in FIG. 6(I). Therefore, the flip-flop circuit 64 stores the signal indicating that the present (latter) fuel supplying operation is carried out in the normal fuel supplying mode.

In addition, the signal levels are "0" and "1" at the inputs of the exclusive-OR circuit 69, and the exclusive-OR circuit 69 produces a signal having a level "1" representing a correction-necessary signal with the timing of the delay circuit 57 as shown in FIG. 6(J). The signal levels is "1" at the inputs of the AND circuit 73, and the AND circuit 73 produces a signal having a level "1" representing the subtraction instruction signal as shown in FIG. 6(K). The gate of the AND circuit 76 is opened by the output of the AND circuit 73. In addition, the output of the AND circuit 73 sets the flip-flop circuit 66 through the monostable multivibrator 55. As a result, the AND circuit 76 produces a signal having a level "1" as the subtraction signal as shown in FIG. 6(Q). This output subtraction signal of the AND circuit 76 is supplied to the input terminal 85E of the supplied quantity counting circuit 85 so as to instruct a subtraction (countdown). The output subtraction signal of the AND circuit 76 is also supplied to the AND circuit 77 through an inverter 83, so as to close the gate of the AND circuit 77. On the other hand, the output of the exclusive-OR circuit 69 is supplied to the AND circuits 72 and 75 so as to open the gates of the AND circuits 72 and 75.

Next, when the lowering switch 27 is closed at the time $t_4$ so as to lower the nozzle 24 from the waiting position B, the detecting circuit 56 produces a separation signal shown in FIG. 6(C) as a one-shot responsive to a fall in the output of the switch 25B that occurs due to the opening of the switch 25B. The output separation signal of the detecting circuit 56, which indicates that the nozzle 24 has separated from the waiting position B, is supplied to the AND circuit 72. The gate of the AND circuit 72 is accordingly open, and a signal having a level "1" as shown in FIG. 6(O) is supplied to the reset terminal 84B of the correcting quantity counting circuit 84 so as to reset the stored correcting quantity related to the previous fuel supplying operation. The flip-flop circuit 65 is set, and the gate of the AND circuit 74 is opened by the Q-output of the flip-flop circuit 65. As a result, the flow quantity signal can be supplied to the correcting quantity counting circuit 84 from the flow quantity generator 19 in this state.

When the nozzle 24 starts to move downwardly and the separation signal is produced from the detecting circuit 56, a one-shot pump driving signal is produced from the delay circuit 63 responsive to a fall in the output separation signal of the detecting circuit 56. This pump driving signal is supplied to the motor control means 43 through the signal line 87. The motor control means 43 supplies a driving signal to the motor control circuit 45 so as to drive the motor 16. Because the first of the two successive fuel supplying operation is carried out in the preset fuel supplying mode, a part of the pipe arrangement 14 and the hose 23 are empty, and the flowmeter 18 operates responsive to the driving of the motor 16. Accordingly, K pulses (1, 2, . . . , K) of the flow quantity signal are successively generated from the flow quantity generator 19 as shown in FIG. 6(L), where K is an integer. Because the gate of the AND circuit 74 is open, the flow quantity signal is supplied to the input terminal 84A of the correcting quantity counting circuit 84 as shown in FIG. 6(N). The correcting quantity counting circuit 84 counts the pulses of the flow quantity signal every time the pulse of the flow quantity signal is supplied to the input terminal 84A, so as to obtain a correcting quantity. The gate of the AND circuit 71 is closed until the nozzle 24 reaches the fuel supplying position C, and the output of the AND circuit 71 is not supplied to the supplied quantity counting circuit 85 as shown in FIG. 6(M).

When the downwardly moving nozzle 24 reaches the fuel supplying position C at the time $t_5$, the switch 25C produces a signal shown in FIG. 6(D). As a result, the gate of the AND circuit 71 is opened, and the monostable multivibrator 52 produces as a one-shot a fuel supplying position arrival signal shown in FIG. 6(E) responsive to a rise in the output of the switch 25C. The output fuel supplying position arrival signal of the monostable multivibrator 52 is supplied to the reset terminal 85C of the supplied quantity counting circuit 85, and resets the counted value related to the previous (first) fuel supplying operation. The indicator driving circuit 86 and the value in the indicator 33 are also reset. The output fuel supplying position arrival signal of the monostable multivibrator 52 is delayed in the delay circuit 60, and is supplied to the input terminal S of the flip-flop circuit 67. The flip-flop circuit 67 produces through the Q-output terminal thereof a signal having a level "1" which represents a reset state latching signal, and supplies this reset state latching signal to the input terminal 86A of the indicator driving circuit 86. As a result, the indicator driving circuit 86 is latched in a state where all of the digits are reset. On the other hand, a one-shot output signal is produced from the delay circuit 61 responsive to a fall in the one-shot output signal of the delay circuit 60, and the AND circuit 75 produces a signal having a level "1" responsive to the output signal of the delay circuit 61. The output of the AND circuit 75 is supplied to the inverter 80 through the OR circuit 82. The output of the inverter 82 shown in FIG. 6(P) instantaneously makes the level of the input terminal 85B of the supplied quantity counting circuit 85 to a low level, so as to renew the correcting quantity data. The delay is performed in two stages by the delay circuits 60 and 61, so that the resetting of the supplied quantity counting circuit 85 through the reset terminal 85C is performed before the incoming correcting quantity data. The fuel supplying position arrival signal is also supplied to the reset terminal R of the flip-flop circuit 65, and the flip-flop circuit 65 is reset so as to close the gate of the AND circuit 74.

Further, when the nozzle 24 is inserted into the fuel tank of the vehicle and the valve of the nozle 24 is opened at the time $t_6$, the fuel is supplied from the nozzle 24, and the flowmeter 18 operates. The flow quantity signal is generated from the flow quantity generator 19. The flow quantity signal is passed through the AND circuit 71, and the output signal of the AND circuit 71 is supplied to the input terminal 85A of the supplied quantity counting circuit 85 so as to start the count. As described before, the output signal of the AND circuit 76 having the level "1" and representing the subtraction signal, is supplied to the input terminal 85E of the supplied quantity counting circuit 85. Further, the signal level is high at the input terminal 85E, and the correcting quantity corresponding to the K pulses of the flow quantity signal counted in the correcting quantity counting circuit 84 is supplied to the input terminal 85D. Hence, the supplied quantity counting circuit 85 subtracts the correcting quantity in a sequence K-1, K-2, . . . every time the pulse of the flow quantity signal is supplied to the input terminal 85A. When the correcting quantity assumes the value "0" as a result of the subtraction, the supplied quantity counting circuit 85 produces through the borrow terminal 85G thereof a borrow signal shown in FIG. 6(R). This borrow signal assumes a low level from a fall in the output of the AND circuit 76 shown in FIG. 6(Q) until a subsequent pulse of the flow quantity signal is received through the input terminal 85A.

On the other hand, the flow quantity signal is supplied to the AND circuit 77 from the AND circuit 71 as shown in FIG. 6(M). However, the gate of the AND circuit 77 is closed, because the output signal of the AND circuit 76 which has the level "1" and represents the subtraction signal is supplied to the AND circuit 77 through the inverter 83. Thus, the flip-flop circuit 67 cannot be reset by the first pulse of the flow quantity signal, and the indicator driving circuit 86 remains latched in the reset state. Consequently, the indicator 33 is held in the reset state while the supplied quantity counting circuit 85 performs the subtacting operation described before. Hence, the borrow signal having a level "0" is produced through the borrow terminal 85G with the same timing as when the correcting quantity becomes equal to "0", and a signal having a level "1" is produced from the inverter 81 and is supplied to the flip-flop circuit 66 through the OR circuit 79 so as to reset the flip-flop circuit 66. Therefore, the AND circuit 76 produces a signal having a level "0" representing the addition signal as shown in FIG. 6(Q). The output addition signal of the AND circuit 76 is supplied to the input terminal 85E of the supplied quantity counting circuit 85, and the supplied quantity counting circuit 85 starts to successively perform the addition from the correcting quantity of "0" in a sequence of "1", "2", "3", . . . . The output of the AND circuit 76 is supplied to the AND circuit 77 through the inverter 83, and opens the gate of the AND circuit 77. The AND circuit 77 supplies a signal having a level "1" to the reset terminal R of the flip-flop circuit 67 as a latch cancelling signal, responsive to the flow quantity signal obtained subsequent to the correcting quantity of "0". As a result, the flip-flop circuit 67 stops producing the reset state latching signal as shown in FIG. 6(S), and the indicator driving circuit 86 supplies a driving signal to the indicator 33 for each of the digits so as to start the successive indication of values "1", "2", "3", "4", . . . .

The latter of the two successive fuel supplying operations is started in the manner described heretofore, and the valve of the nozzle 24 is closed when the quantity of supplied fuel reaches a desired quantity.

Next, description will be given for a case where the two successive fuel supplying operations are carried out in the preset fuel supplying mode, by referring to a time chart shown in FIG. 7. In this case, a part of the pipe arrangement 14 and the hose 23 are empty after the first of the two successive fuel supplying operations is carried out, as described before in conjunction with FIG. 1C. However, a part of the pipe arrangement 14 and the hose 23 become empty again after the latter of the two succesive fuel supplying operation is completed. Hence, the correcting quantity corresponding to the K pulses of the flow quantity signal generated by the flow quantity generator 19 while a part of the pipe arrangement 14 and the hose 23 are filled by the fuel, can be added as it is.

Figure 6:
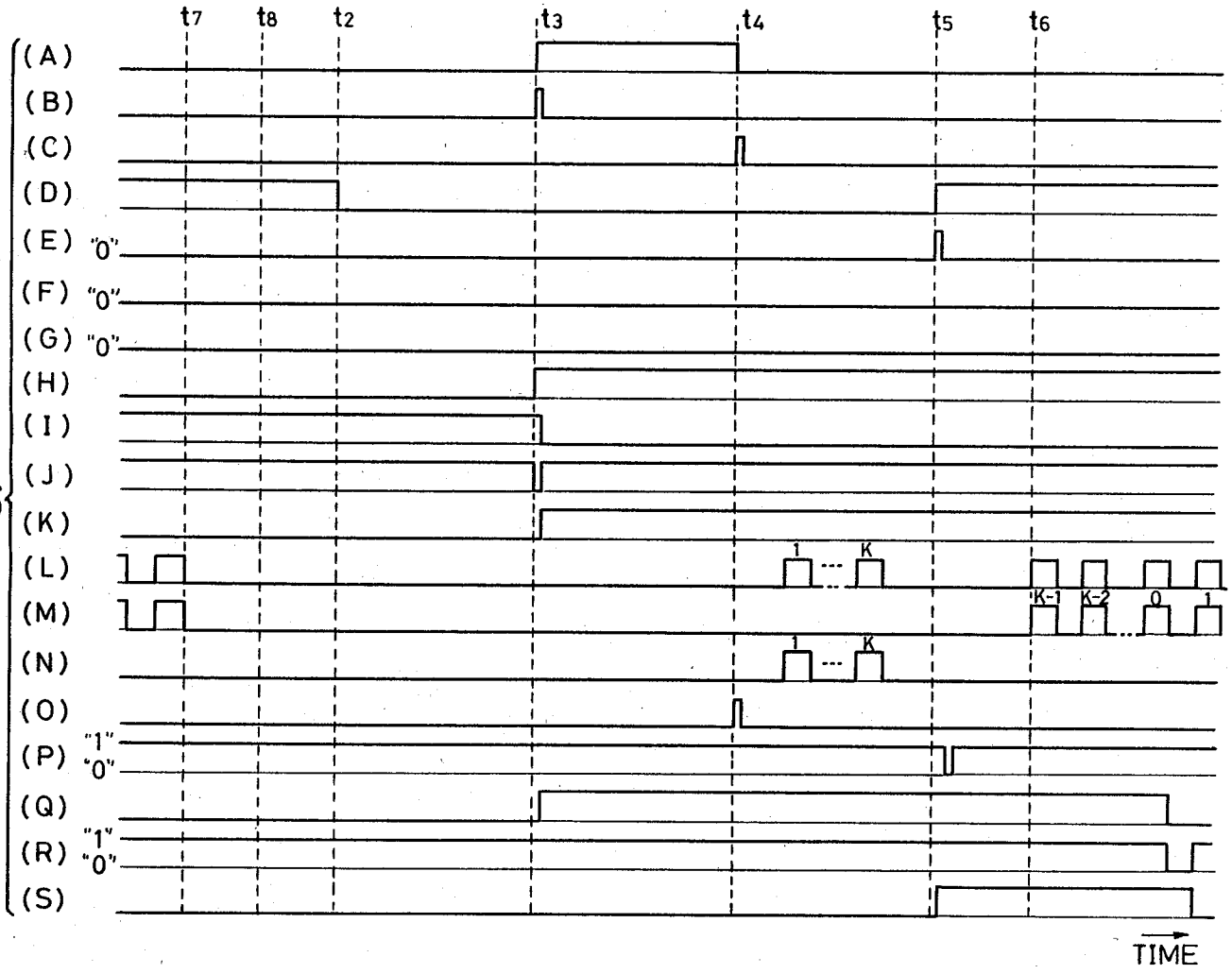
FIGS. 6(A) through 6(S) are time charts showing output signals at each part of the circuit system shown in FIG. 4 for a case where the first of two successive fuel supplying operations is carried out in a preset fuel supplying mode and the latter of the two successive fuel supplying operations is carried out in the normal fuel supplying mode.
Figure 7:
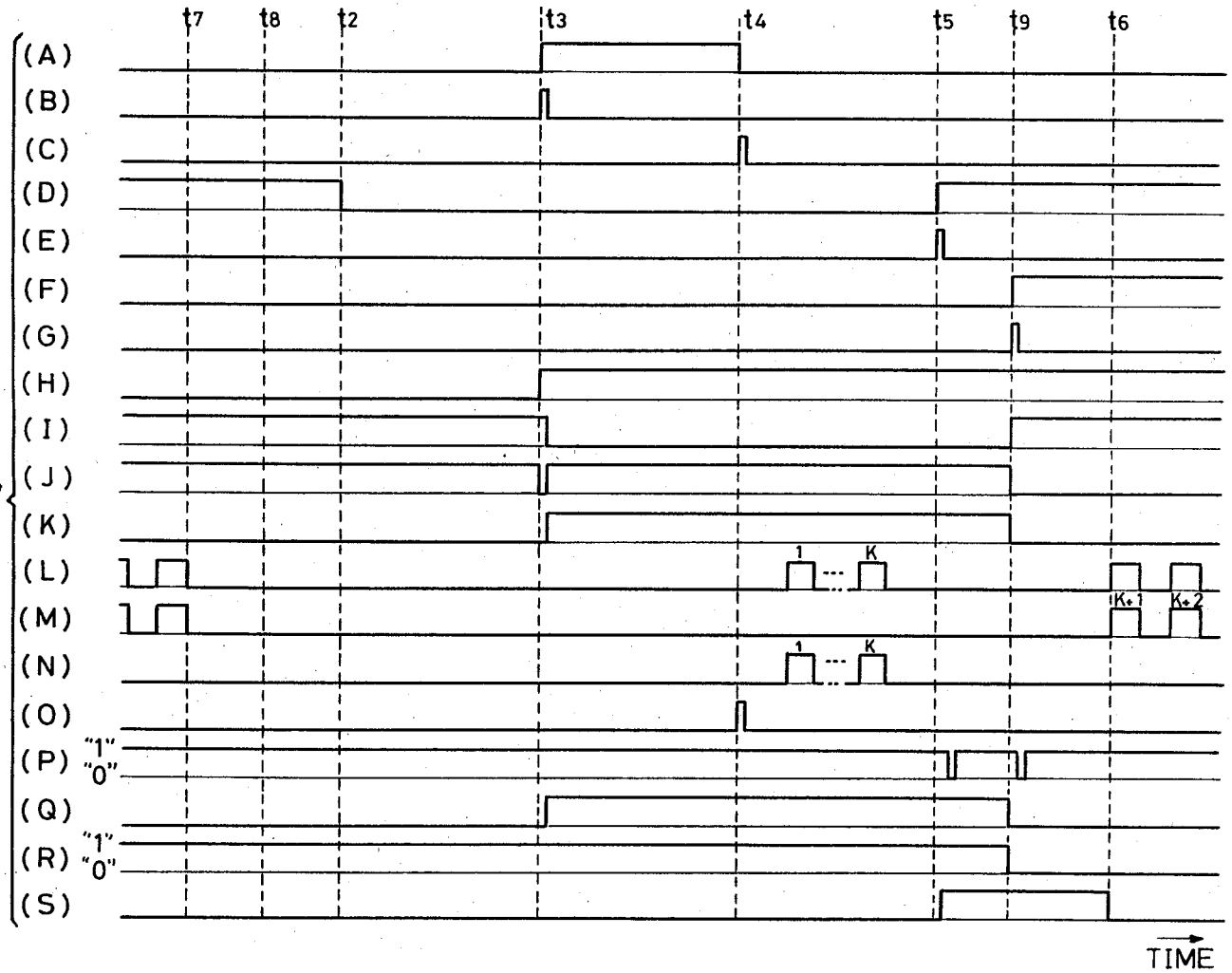
FIGS. 7(A) through 7(S) are time charts showing output signals at each part of the circuit system shown in FIG. 4 for a case where the first of two successive fuel supplying operations is carried out in the preset fuel supplying mode and the latter of the two successive fuel supplying operations is also carried out in the preset fuel supplying mode.

Because the first of the two successive fuel supplying operations is carried out in the preset fuel supplying mode, the sequence of operations shown in FIG. 7 starting from the time $t_7$ when the preset fuel supplying operation is completed and including the nozzle raising operation performed at the time $t_2$, the detection of the waiting position B performed at the time $t_3$, the lowering of the nozzle performed at the time $t_4$, and the detection of the fuel supplying position C performed at the time $t_5$, are the same as the operations shown in FIG. 6. Thus, description thereof will be omitted.

It will be assumed that the preset switch 29 is manipulated so as to preset a desired preset fuel supplying quantity at a time $t_9$, after the nozzle 24 has reached the fuel supplying position C. The preset fuel supplying quantity is stored in the preset control means 42. On the other hand, when a preset supply signal shown in FIG. 7(F) is produced from the preset switch 29 responsive to the manipulation thereof, a one-shot output shown in FIG. 7(G) is produced from the monostable multivibrator 53 responsive to a rise in the preset supply signal. The output signal of the monostable multivibrator 53 is supplied to the input terminal S of the flip-flop circuit 64. As a result, a signal indicating that the mode of the present (latter) fuel supplying operation is changed from the normal fuel supplying mode to the preset fuel supplying mode, is stored in the flip-flop circuit 64. The output signal of the flip-flop circuit 64 having a level "1" and indicating the preset fuel supplying mode, is supplied to the exclusive-OR circuit 69. Hence, the signal level at the inputs of the exclusive-OR circuit 69 becomes "1", and a signal having a level "0" and indicating the correction-unnecessary signal shown in FIG. 7(J) is produced from the exclusive-OR circuit 69. The signal level at the output of the AND circuit 73 becomes "0" as shown in FIG. 7(K), and no subtraction instruction signal is produced from the AND circuit 73. A correction cancellation detection signal is produced as a one-shot from the detecting circuit 62 responsive to a fall in the output of the exclusive-OR circuit 69. The correction cancellation detection signal is supplied to the flip-flop circuit 66 through the OR circuit 79, so as to reset the flip-flop circuit 66. Accordingly, the signal level at the inputs of the AND circuit 76 is "0", and the AND circuit 76 produces a signal having a level "0" and representing the addition signal. The addition signal is supplied to the input terminal 85E of the supplied quantity counting circuit 85 so as to instruct an addition (count-up). The additon signal is also supplied to the AND circuit 77 through the inverter 83, so as to open the gate of the AND circuit 77 and prepare the AND circuit 77 for cancelling the latch.

On the other hand, the preset supply signal from the preset switch 29 is supplied to the AND circuit 70. The gate of the AND circuit 70 is open because the switch 25C is closed. Hence, the AND circuit 70 produces a signal having a level "1" responsive to the preset supply signal, and the monostable multivibrator 54 produces a one-sot output shown in FIG. 7(I). As a result, the delay circuit 59 produces a delayed signal responsive to a fall in the one-shot output of the monostable multivibrator 54, and the output delayed signal of the delay circuit 59 is supplied to the inverter 82 through an OR circuit 80. Thus, the signal level at the input terminal 85B of the correcting quantity counting circuit 85 instantaneously assumes a low level responsive to the output of the inverter 82 shown in FIG. 7(P), with the timing of the delay circuit 59, and the correcting quantity is renewed.

When the nozzle 24 is inserted into the fuel tank of the vehicle and the valve of the nozzle 24 is opened, the fuel is supplied from the nozzle 24 and the flow quantity generator 19 generates a flow quantity signal shown in FIG. 7(L). The flow quantity signal is passed through the AND circuit 71, and is supplied to the input terminal 85A of the supplied quantity counting circuit 85 as shown in FIG. 7(M). The supplied quantity counting circuit 85 starts to count the pulses of the flow quantity signal. In this state, the output addition signal of the AND circuit 76 having the level "0" is supplied to the input terminal 85E of the supplied quantity counting circuit 85, and the signal level is high at the input terminal 85B. Further, the correcting quantity corresponding to the K pulses of the flow quantity signal counted in the correcting quantity counting circuit 84, is supplied to the input terminal 85D. Therefore, the supplied quantity counting circuit 85 successively performs addition with respect to the correcting quantity in a sequence of K+1, K+2, . . . , every time the pulse of the flow quantity signal is supplied to the input terminal 85A. On the other hand, the flip-flop circuit 67 is reset responsive to the first pulse of the flow quantity signal, since the gate of the AND circuit 77 is open. Accordingly, the flip-flop circuit 67 stops producing the reset state latching signal, and the indicator driving circuit 86 supplies a driving signal to the indicator 33 for each of the digits so as to start the successive indication of values "K+1", "K+2", . . . .

When the quantity of supplied fuel reaches the preset fuel supplying quantity, the predetermined quantity signal is produced from the preset control means 42, and the motor 16 is stopped. In this case, the actual quantity of supplied fuel is less than the preset fuel supplying quantity by a correcting quantity which corresponds to K pulses of the flow quantity signal. However, during the preset fuel supplying operation, the fuel which is within a part of the pipe arrangement 14 and the hose 23 and corresponds to the correcting quantity flows out from the nozzle 24, even after the predetermined quantity signal is produced from the preset control means 42. Hence, the quantity of fuel which is finally supplied, is accurately equal to the preset fuel supplying quantity. When the preset switch 29 is manipulated and returned to the original state after the preset fuel supplying operation is completed, a one-shot output is produced from the detecting circuit 58 responsive to a fall in the output of the preset switch 29. As a result, the flip-flop circuit 64 is reset and returned to a state where the signal indicating the normal fuel supplying mode is stored therein.

Next, description will be given for a case where the first of the two successive fuel supplying operations is carried out in the normal fuel supplying mode and the latter of the two successive fuel supplying operations is carried out in the normal fuel supplying mode, by referring to a time chart shown in FIG. 8. In this case, the fuel within a part of the pipe arrangement 14 and the hose 23 flows out from the nozzle 24 even after the supply of fuel is stopped responsive to the predetermined quantity signal, as described before in conjunction with FIG. 1D. For this reason, the correcting quantity stored in the correcting quantity counting circuit 84 is read out during the first fuel supplying operation (it does not matter how many times the normal fuel supplying operation is carried out after the first fuel supplying operation carried out in the preset fuel supplying mode), and and the counting is performed by adding the correcting quantity to the quantity of supplied fuel.

Figure 8:
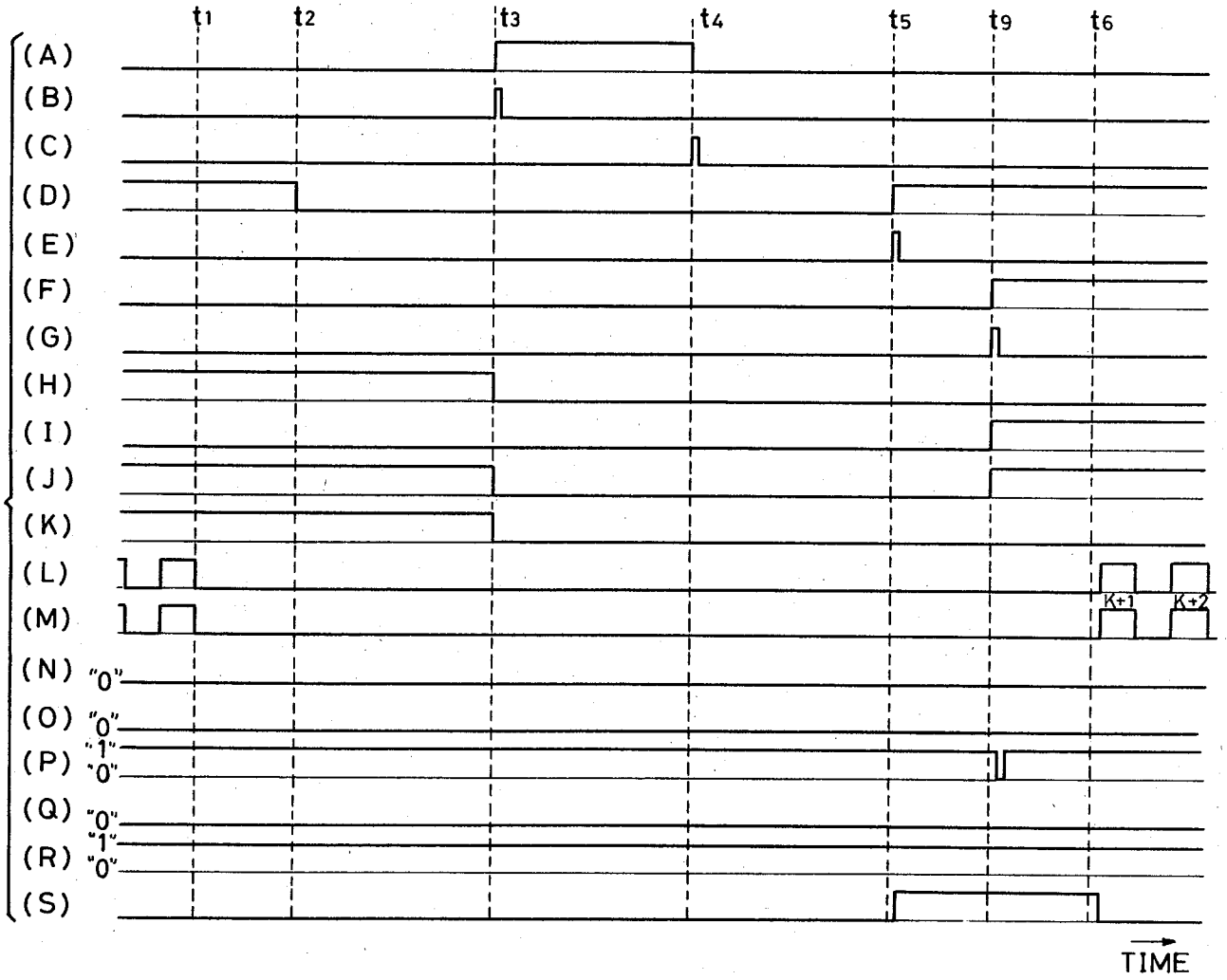
FIGS. 8(A) through 8(S) are time charts showing output signals at each part of the circuit system shown in FIG. 4 for a case where the first of two successive fuel supplying operations is carried out in the normal fuel supplying mode and the latter of the two successive fuel supplying operations is carried out in the preset fuel supplying mode.

Because the first of the two successive fuel supplying operations is carried out in the normal fuel supplying mode, the sequence of operations shown in FIG. 8 starting from the time $t_1$ when the normal fuel supplying operation is completed and including the nozzle raising operation performed at the time $t_2$, the detection of the waiting position B performed at the time $t_3$, the lowering of the nozzle performed at the time $t_4$, and the detection of the fuel supplying position C performed at the time $t_5$, are the same as the operations shown in FIG. 5. Thus, description thereof will be omitted. In this case where the first of the two successive fuel supplying operations is carried out in the normal fuel supplying mode, no preset operation is performed at the point when the nozzle 24 separates from the waiting position B and the one-shot output is produced from the delay circuit 56. Hence, the signal level at the outputs of the flip-flop circuits 68 and 64 is "0", and the signal level at the output of the exclusive-OR circuit 69 is also "0". A signal for resetting the correcting quantity is not supplied to the correcting quantity counting circuit 84 from the AND circuit 72 as in the case where the first of the two successive fuel supplying operations is carried out in the preset fuel supplying mode.

When the preset switch 29 is manipulated at a time $t_9$ so as to preset a desired preset fuel supplying quantity after the nozzle 24 has reached the fuel supplying position C, the preset fuel supplying quantity is stored in the preset control means 42. On the other hand, when the preset supply signal is produced from the preset switch 29 responsive to the manipulation of the preset switch 29, a one-shot output is produced from the monostable multivibrator 53 responsive to a rise in the preset supply signal. The output of the monostable multivibrator 53 is supplied to the flip-flop circuit 64. As a result, the flip-flop 64 stores a signal indicating that the mode of the present (latter) fuel supplying operation is changed from the normal fuel supplying mode to the preset fuel supplying mode. The output signal of the flip-flop 64 having a level "1" and indicating the preset fuel supplying mode, is supplied to the exclusive-OR circuit 69. On the other hand, the output signal of the flip-flop circuit 68 having a level "0" is also supplied to the exclusive-OR circuit 69, and thus, the exclusive-OR circuit 69 supplies a signal having a level "1" to the AND circuit 73. However, because the signal level at the output of the flip-flop circuit 68 is "0", the AND circuit 73 produces a signal having a level "0" indicating addition. The AND circuit 76 supplies the addition signal to the input terminal 85E of the supplied quantity counting circuit 85, and the AND circuit 87 is prepared for cancelling the latch.

On the other hand, the output preset supply signal of the preset switch 29 is supplied to the AND circuit 70. As described before in conjunction with FIG. 7 for the preset fuel supplying operation, the one-shot output of the delay circuit 59 is supplied to the inverter 82, so that the signal level at the input terminal 85B of the supplied quantity counting circuit 85 instantaneously assumes a low level. Accordingly, the correcting quantity data (the correcting quantity data which is related to the most recent preset fuel supplying operation and is stored in the correcting quantity counting circuit 84) stored in the correcting quantity counting circuit 84 is read out and renewed.

When the valve of the nozzle 24 is opened, the flow quantity signal is supplied to the supplied quantity counting circuit 85 and counted. In this state, the addition signal having the level "0" is supplied to the input terminal 85E of the supplied quantity counting circuit 85. Moreover, the correcting quantity corresponding to K pulses of the flow quantity signal counted in the correcting quantity counting circuit 84, is supplied to the input terminal 85D of the supplied quantity counting circuit 85. Therefore, the supplied quantity counting circuit 85 successively performs addition with respect to the correcting quantity in a sequence of $K+1$, $K+2$, . . . , every time the pulse of the flow quantity signal is supplied to the input terminal 85A.

When the quantity of supplied fuel reaches the preset fuel supplying quantity, the predetermined quantity signal is produced from the preset control means 42, and the motor 16 stops. In this case, the actual quantity of supplied fuel is less than the preset fuel supplying quantity by a correcting quantity which corresponds to K pulses of the flow quantity signal, because the predetermined quantity signal is produced in a state where the K pulses of the flow quantity signal are added in advance. However, during the preset fuel supplying operation, the fuel which is within a part of the pipe arrangement 14 and the hose 23 and corresponds to the correcting quantity flows out from the nozzle 24, even after the predetermined quantity signal is produced from the preset control means 42. Hence, the quantity of fuel which is finally supplied, is accurately equal to the preset fuel supplying quantity.

According to the embodiment described heretofore, addition or subtraction is performed depending on the combination of the fuel supplying modes of two successive fuel supplying operations, so that it is always possible to carry out an accurate fuel supplying operation.

In the embodiment described heretofore, the nozzle 24 is returned to the waiting position B from the fuel supplying position C every time one fuel supplying operation is completed. However, an instruction switch for instructing fuel supplying operations to be carried out continuously, may be provided on the switch box 26. In this case, the nozzle 24 will remain in the fuel supplying position C when the instruction switch is manipulated after one fuel supplying operation is completed, so that a plurality of fuel supplying operations may be carried out continuously.

The fuel supplying system according to the present invention is designed to store the fuel supplying mode of the first of two successive fuel supplying operations, and the correcting quantity is added or subtracted depending on the fuel supplying mode of the latter of the two successive fuel supplying operations so as to fill a part of the pipe arrangement and the hose with the fuel. Accordingly, it is possible to carry out an accurate fuel supplying operation regardless of the combination of the fuel supplying modes of the successive fuel supplying operations. Therefore, an error will not occur in the actual quantity of supplied fuel as in the case of the conventional fuel supplying system, regardless of the combination of the fuel supplying modes of the successive fuel supplying operations.

In the embodiment described heretofore, the fuel supplying operation in each of the fuel supplying modes is controlled by the measurement control circuit shown in FIG. 4. However, the operation of the measurement control circuit may be performed by a microcomputer by controlling the program thereof.

Description will now be given with respect to embodiments wherein a microcomputer is used.

Figure 9:
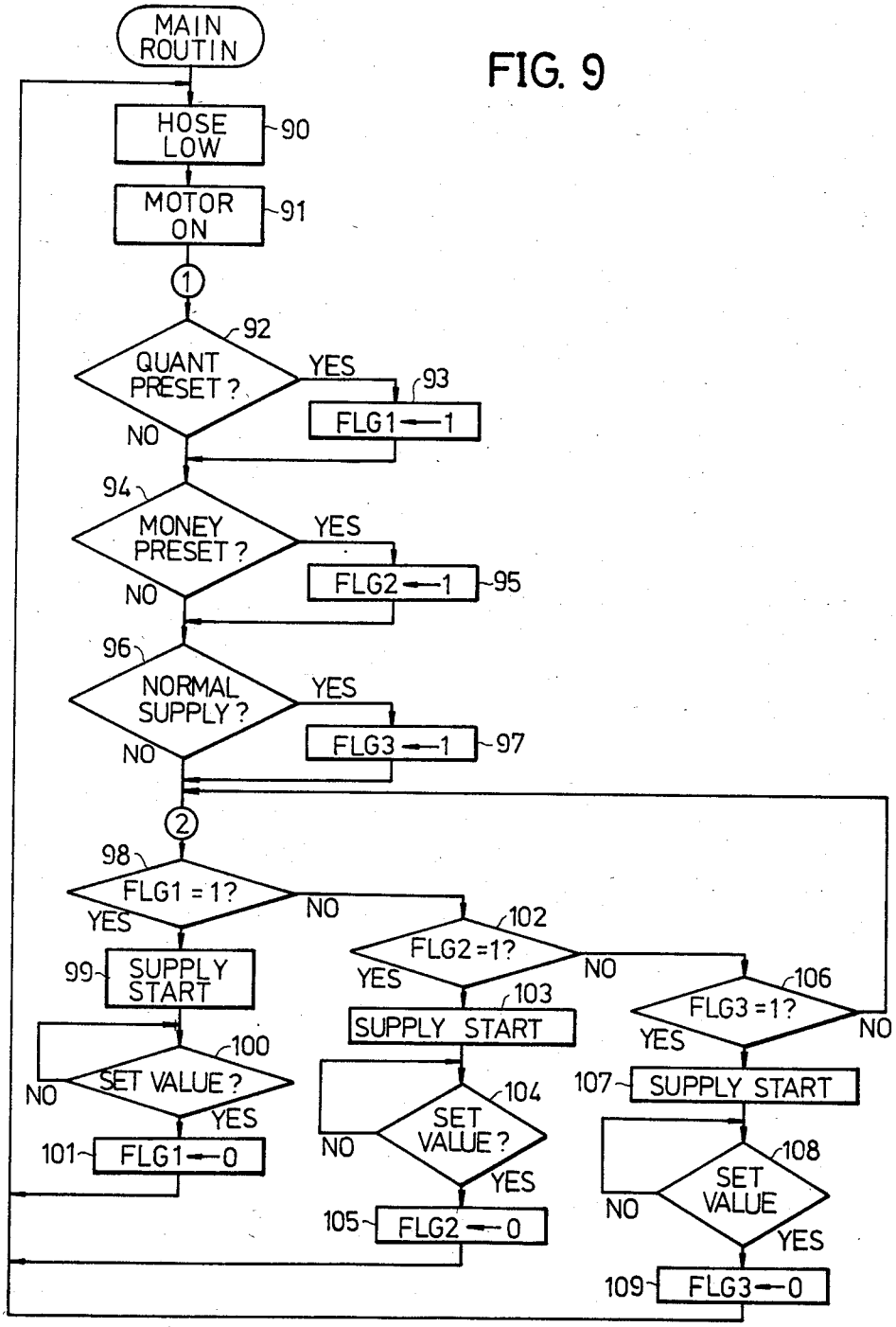
FIG. 9 is a flow chart showing a main routine of a microcomputer for explaining an embodiment in which the fuel supplying system according to the present invention is realized by the microcomputer.

In a main routine of the microcomputer shown in FIG. 9, the fuel supplying hose 23 and the fuel supplying nozzle 24 are lowered in a step 90. A step 91 detects that the nozzle 24 has been lowered to a predetermined position, and drives the motor 16. The operation of the microcomputer continues to a subroutine shown in FIG. 10 at a position ①.

Figure 10:
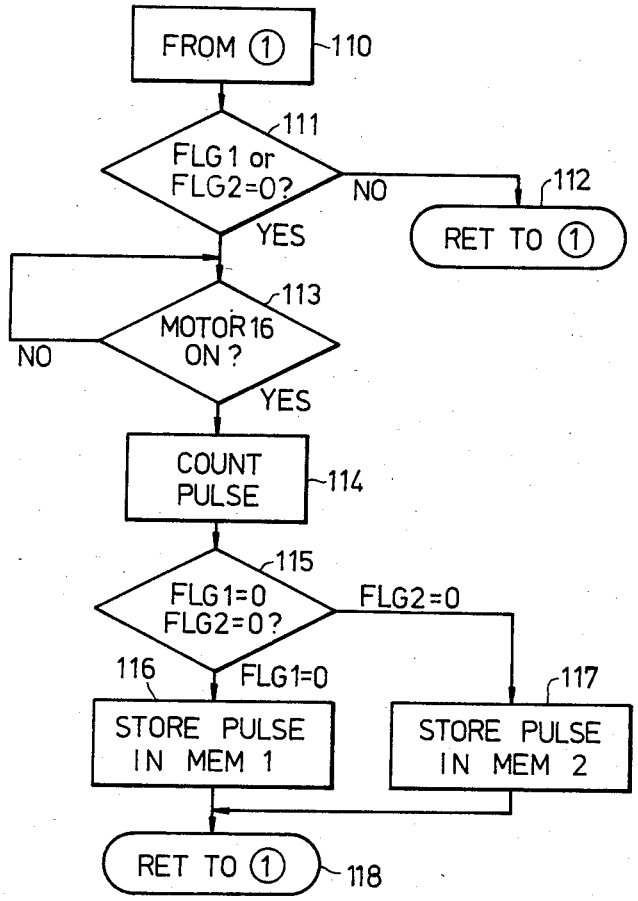
FIG. 10 is a flow chart showing a subroutine which starts from a position ① of the main routine shown in FIG. 9.

The subroutine shown in FIG. 10 starts from a step 110 and a step 111 discriminates whether a flag FLG1 or FLG2 is equal to "0". The flag FLG1 is equal to "0" when the first of two successive fuel supplying operations is carried out in a first preset fuel supplying mode in which the fuel supplying quantity is preset, and is equal to "1" when the latter of the two successive fuel supplying operations is carried out in the first preset fuel supplying mode in which the fuel supplying quantity is preset. On the other hand, the flag FLG2 is equal to "0" when the first of the two successive fuel supplying operations is carried out in a second preset fuel supplying mode in which the price of fuel to be supplied is preset, and is equal to "1" when the latter of the two successive fuel supplying operations is carried out in the second preset fuel supplying mode in which the price of the fuel to be supplied is preset. A flag FLG3 which will be described later, is equal to "0" when the first of the two successive fuel supplying operations is carried out in the normal fuel supplying mode, and is equal to "1" when the latter of the two successive fuel supplying operations is carried out in the normal fuel supplying mode.

The step 111 discriminates whether the flag FLG1 or FLG2 is equal to "0", that is, whether the first of the two successive fuel supplying operations is carried out in the first preset fuel supplying mode in which the fuel supplying quantity is preset or in the second preset fuel supplying mode in which the price of fuel to be supplied is preset. When the discrimination result in the step 111 is NO, a step 112 returns the operation of the microcomputer to the position ① shown in and advances the operation to a step 92.

On the other hand, when the discrimination result in the step 111 is YES, a step 113 discriminates whether the motor 16 is ON. When the discrimination result in the step 113 is YES, a step 114 counts the pulses of the flow quantity signal generated from the flow quantity generator 19. The number of pulses counted in the step 114, corresponds to a quantity of fuel which is required during the latter fuel supplying operation to fill a part of the pipe arrangement 14 and the hose 23 which becomes empty after completion of the first fuel supplying operation carried out in the preset fuel supplying mode. A step 115 discriminates whether the flag FLG1 is equal to "0" or the flag FLG2 is equal to "0". When the flag FLG1 is equal to "0", a step 116 stores the counted number of pulses corresponding to the fuel supplying quantity into a first memory MEM1. On the other hand, when the flag FLG2 is equal to "0", a step 117 stores the counted number of pulses corresponding to the price of fuel to be supplied into a second memory MEM2. Thereafter, a step 118 returns the operation of the microcomputer to the position ① shown in FIG. 9, and the operation advances to the step 92.

The step 92 discriminates whether the fuel supplying quantity has been preset. When the discrimination result in the step 92 is YES, a step 93 sets the flag FLG1 to "1", and the preset fuel supplying quantity is preset. On the other hand, when the discrimination result in the step 92 is NO, a step 94 discriminates whether the price of fuel to be supplied has been preset. When the discrimination result in the step 94 is YES, a step 95 sets the flag FLG2 to "1", and the price of fuel to be supplied is preset. A step 96 discriminates whether the fuel supplying operation is to be carried out in the normal fuel supplying mode, when the discrimination result in the step 94 is NO. When the discrimination result in the step 96 is YES, a step 97 sets the flag FLG3 to "1", and the it is determined that the normal fuel supplying operation is to be carried out. The operation of the microcomputer advances to a position ② when the discrimination result in the step 96 is NO.

Figure 11A:
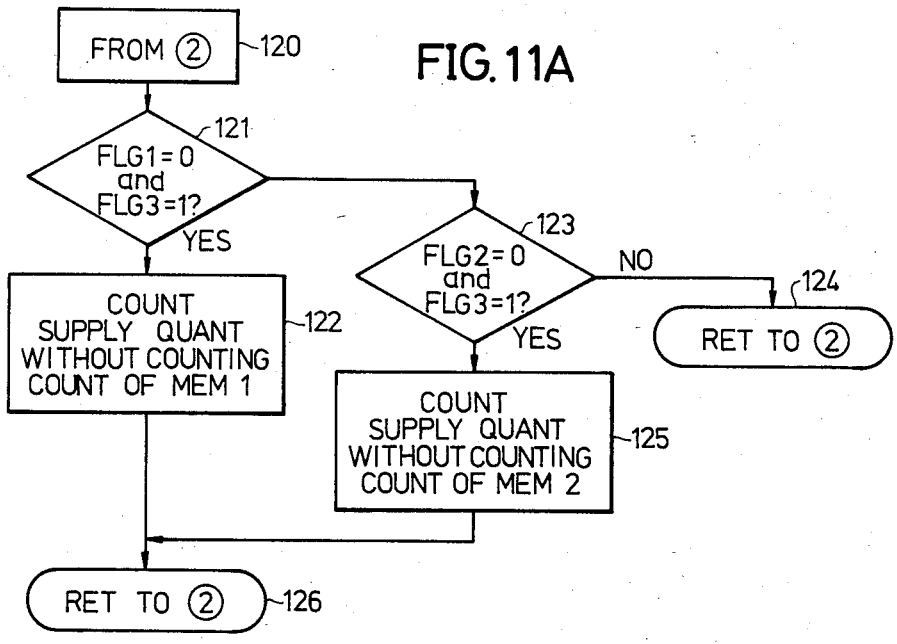
FIGS. 11A and 11B are flow charts showing subroutines which start from a position ② of the main routine shown in FIG. 9.
Figure 11B:
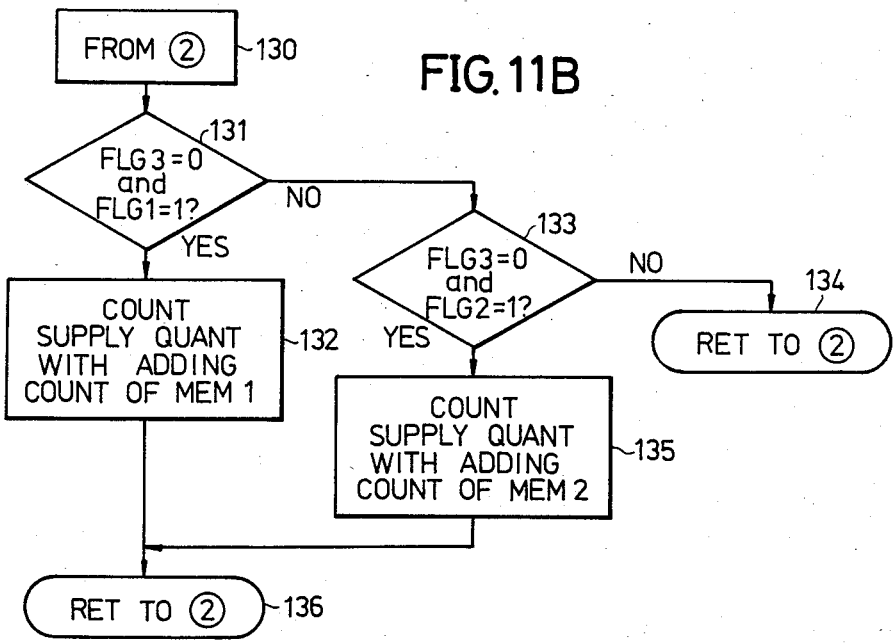

The operation of the microcomputer continues to a subroutine shown in FIG. 11A or FIG. 11B at the position ②. The subroutine shown in FIG. 11A starts from a step 120, and a step 121 discriminates whether the flag FLG1 is equal to "0" and the flag FLG3 is equal to "1". When the discrimination result in the step 121 is YES, a step 122 counts the quantity of supplied fuel without counting the count in the memory MEM1. On the other hand, when the discrimination result in the step 121 is NO, a step 123 discriminates whether the flag FLG2 is equal to "0" and the flag FLG3 is equal to "1". The steps 121 and 123 discriminate whether the first of the two successive fuel supplying operations is carried out in the preset fuel supplying mode and the latter of the two successive fuel supplying operations is carried out in the normal fuel supplying mode. When the discrimination result in the step 123 is NO, a step 124 returns the operation of the microcomputer to the position ② shown in FIG. 9. On the other hand, when the discrimination result in the step 123 is YES, a step 125 counts the quantity of supplied fuel without counting the count in the memory MEM2. When advancing to the step 122 or 125, it means that the first of the two successive fuel supplying operations is carried out in the preset fuel supplying mode and the latter of the two successive fuel supplying operations is carried out in the normal fuel supplying mode. In other words, a part of the pipe arrangement 14 and the hose 23 is empty when starting the fuel supplying operation, and the error introduced due to the quantity of fuel required to fill the empty part of the pipe arrangement 14 and the hose 23 is corrected by counting the quantity of supplied fuel without counting the count in the step 122 or 125. After the step 122 or 125 is performed, a step 126 returns the operation of the microcomputer to the position ② shown in FIG. 9.

The subroutine shown in FIG. 11B starts from a step 130, and a step 131 discriminates whether the flag FLG3 is equal to "0" and the flag FLG1 is equal to "1". When the discrimination result in the step 131 is YES, a step 132 counts the quantity of supplied fuel by adding the count in the memory MEM1. On the other hand, when the discrimination result in the step 131 is NO, a step 133 discriminates whether the flag FLG3 is equal to "0" and the flag FLG2 is equal to "1". The steps 131 and 133 discriminate whether the first of the two successive fuel supplying operations is carried out in the normal fuel supplying mode and the latter of the two successive fuel supplying operations is carried out in the preset fuel supplying mode. When the discrimination result in the step 133 is NO, a step 134 returns the operation of the microcomputer to the position ② shown in FIG. 9. On the other hand, when the discrimination result in the step 133 is YES, a step 135 counts the quantity of supplied fuel by adding the count in the memory of MEM2. When advancing to the step 132 or 135, it means that the first of the two successive fuel supplying operations is carried out in the normal fuel supplying mode and the latter of the two successive fuel supplying operations is carried out in the preset fuel supplying mode. In other words, a part of the pipe arrangement 14 and the hose 23 is filled by the fuel when starting the fuel supplying operation, and the error introduced due to the quantity of fuel which flows out of the nozzle 24 from a part of the pipe arrangement 14 and the hose 23 when the latter fuel supplying operation is completed is corrected by counting the quantity of supplied fuel by adding the count in the step 132 or 135. After the step 132 or 135 is performed, a step 136 returns the operation of the microcomputer to the position ② shown in FIG. 9.

When the operation of the microcomputer is returned to the position ② shown in FIG. 9, a step 98 discriminates whether the flag FLG1 is equal to "1". When the discrimination result in the step 98 is YES, a step 99 starts the fuel supplying operation. A step 100 discriminates whether the quantity of supplied fuel has reached a set value. The flag FLG1 is reset to "0" in a step 101 and the operation is returned to the step 90 when the discrimination result in the step 100 is YES. On the other hand, when the discrimination result in the step 98 is NO, a step 102 discriminates whether the flag FLG2 is equal to "1". When the discrimination result in the step 102 is YES, a step 103 starts the fuel supplying operation. A step 104 discriminates whether the quantity of supplied fuel has reached a set value. The flag FLG2 is reset to "0" in a step 105 and the operation is returned to the step 90 when the discrimination result in the step 104 is YES. On the other hand, when the discrimination result in the step 102 is NO, a step 106 discriminates whether the flag FLG3 is equal to "1". When the discrimination result in the step 106 is YES, a step 107 starts the fuel supplying operation. A step 108 discriminates whether the quantity of supplied fuel has reached a set value. The flag FLG3 is reset to "0" in a step 109 and the operation is returned to the step 90 when the discrimination result in the step 108 is YES.

According to the present embodiment, the steps 110, 120, and 130 advance the operation of the microcomputer to the respective subroutines. However, when it is necessary to perform other programs for carrying out control, it is preferable to make the steps 110, 120, and 130 timer interrupt steps of 4.8 msec each, for example.

Further, the present invention is not limited to these embodiments, but various variations and modifications may be made without departing from the scope of the present invention.

What is claimed is:

1. A fuel supplying system for a fuel supplying apparatus which comprises a fuel supplying nozzle provided on a tip end of a fuel supplying hose, said fuel supplying nozzle having a valve, a pump for supplying a fuel to said fuel supplying hose, a flowmeter for measuring a flow quantity of the fuel which is supplied by said pump and for producing a flow quantity signal in correspondence with a supplied quantity of fuel which is measured, an indicator for indicating a supplied quantity of fuel based on the flow quantity signal from said flowmeter, a preset switch for presetting a preset fuel supplying quantity when carrying out a preset fuel supplying operation, and fuel supply stopping means for stopping the supply of fuel when the quantity of supplied fuel reaches the preset fuel supplying quantity, said fuel supplying system comprising:

previous mode storing means for discriminating whether a previous fuel supplying operation is carried out in a normal fuel supplying mode or a preset fuel supplying mode which is determined by a manipulation of said preset switch, and for storing a discriminated fuel supplying mode of the previous fuel supplying operation;

present mode storing means for discriminating whether a present fuel supplying operation is carried out in the normal fuel supplying mode or the preset fuel supplying mode, and for storing a discriminated fuel supplying mode of the present fuel supplying operation;

correcting quantity storing means for counting the flow quantity signal generated from said flowmeter when the fuel flows through said flowmeter so as to fill said fuel supplying hose before the valve of said fuel supplying nozzle is opened upon starting of the present fuel supplying operation, and for storing a counted value as a correcting quantity; and quantity correcting means for reading out the correcting quantity stored in said correcting quantity storing means depending on the previous fuel supplying mode and the present fuel supplying mode which are stored in the respective mode storing means, and for correcting a fuel supplying quantity of the present fuel supplying operation according to the previous fuel supplying mode.

2. A fuel supplying system as claimed in claim 1 which further comprises means for making said quantity correcting means inoperative when said previous fuel supplying mode is the normal fuel supplying mode and said present fuel supplying mode is also the normal fuel supplying mode.

3. A fuel supplying system as claimed in claim 1 in which said quantity correcting means performs a subtracting operation with respect to said correcting quantity when said previous fuel supplying mode is the preset fuel supplying mode and said present fuel supplying mode is the normal fuel supplying mode.

4. A fuel supplying system as claimed in claim 3 which further comprises means for maintaining said indicator in a reset state while said quantity correcting means performs the subtracting operation.

5. A fuel supplying system as claimed in claim 1 in which said quantity correcting means performs an adding operation with respect to said correcting quantity when said previous fuel supplying mode is the normal fuel supplying mode and said present fuel supplying mode is the preset fuel supplying mode.

6. A fuel supplying system as claimed in claim 1 in which said previous mode storing means and said present mode storing means are respectively constituted by a flip-flop which inverts an output polarity thereof responsive to the stored fuel supplying mode.

* * * * *